United States Patent [19]

Levasseur

[11] Patent Number: 5,050,769

[45] Date of Patent: Sep. 24, 1991

[54] VEND SPACE ALLOCATION MEANS AND METHOD

[75] Inventor: Joseph L. Levasseur, St. Louis, Mo.

[73] Assignee: Coin Acceptors, Inc., St. Louis, Mo.

[21] Appl. No.: 336,348

[22] Filed: Apr. 11, 1989

[51] Int. Cl.[5] ..... G07F 11/10

[52] U.S. Cl. ..... 221/001; 221/2; 221/6; 364/403; 364/479

[58] Field of Search ..... 221/1, 2, 6, 7, 8; 364/403, 479

[56] References Cited

U.S. PATENT DOCUMENTS

| | | | |
|---|---|---|---|
| 4,223,210 | 9/1980 | Verduin . | |
| 4,245,755 | 1/1981 | Craven et al. | 221/109 |
| 4,359,147 | 11/1982 | Levasseur | 221/13 X |
| 4,520,451 | 5/1985 | McLaughlin | 364/900 |
| 4,598,378 | 7/1986 | Giacomo | 364/479 |
| 4,639,875 | 1/1987 | Abraham et al. | 221/2 X |
| 4,654,800 | 3/1987 | Hayashi et al. | 364/479 |
| 4,699,295 | 10/1987 | Cedrone et al. | 221/108 |
| 4,705,176 | 11/1987 | Oden | 221/176 X |
| 4,834,231 | 5/1989 | Awane et al. | 221/7 |
| 4,991,739 | 2/1991 | Levasseur | 221/14 |

FOREIGN PATENT DOCUMENTS

| | | |
|---|---|---|
| 0071275 | 7/1982 | European Pat. Off. . |
| 0072141 | 2/1983 | European Pat. Off. . |

*Primary Examiner*—F. J. Bartuska

*Attorney, Agent, or Firm*—Haverstock, Garrett & Roberts

[57] ABSTRACT

A vend space allocation apparatus and method for use with a vending system capable of vending from among a plurality of classes of selectable vendable products a product from a selected product class, which vending system has a plurality of product storage areas and an established vend space allocation configuration allocating the product storage areas to the classes of selectable vendable products, the vend space allocation apparatus including a vend selection monitoring portion for monitoring over a period of time the historical demand for the various classes of selectable vendable products, a determining portion for determining, based at least in part upon said historical demand, space allocation information indicative of a preferred vend space allocation configuration for the vending system, and a display for communicating to authorized personnel such space allocation information.

95 Claims, 32 Drawing Sheets

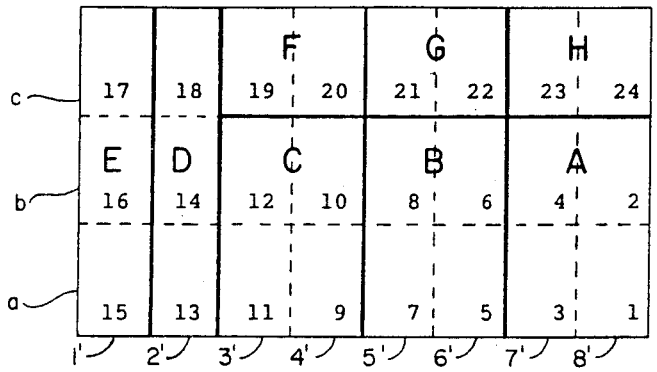

Fig. 9

| Selection | Total Capacity | Product Allocation % | Product Availability At Servicing |
|---|---|---|---|
| SELECTION A | 72 | 16.67 | EMPTY |
| SELECTION B | 72 | 16.67 | EMPTY |
| SELECTION C | 72 | 16.67 | 9 |
| SELECTION D | 54 | 12.50 | 16 |
| SELECTION E | 54 | 12.50 | 12 |
| SELECTION F | 36 | 8.33 | 13 |
| SELECTION G | 36 | 8.33 | 13 |
| SELECTION H | 36 | 8.33 | 17 |

Fig. 10

PRODUCT SALES ACTIVITY

| Product | A | B | C | D | E | F | G | H | Total |
|---|---|---|---|---|---|---|---|---|---|
| % Alloc. | 16.67 | 16.67 | 16.67 | 12.50 | 12.50 | 8.33 | 8.33 | 8.33 | 100 |
| Day 1 | 16 | 14 | 4 | 5 | 4 | 2 | 4 | 0 | 49 |
| Day 2 | 22 | 12 | 7 | 2 | 3 | 4 | 2 | 1 | 53 |
| Day 3 | 21 | 13 | 5 | 3 | 7 | 5 | 1 | 3 | 58 |
| Day 4 | 13 | 11 | 4 | 3 | 4 | 3 | 1 | 2 | |
| ----------1st Sell-Out---------- | | | | | | | | | |
| | 0 | 6 | 4 | 3 | 2 | 0 | 2 | 1 | 59 |
| Day 5 | 0 | 16 | 10 | 16 | 7 | 1 | 6 | 4 | 60 |
| Day 6 | 0 | 0 | 15 | 9 | 7 | 4 | 3 | 4 | 42 |
| Day 7 | 0 | 0 | 14 | 7 | 8 | 4 | 4 | 4 | 41 |
| Total Delvd. By Service Date | 72 | 72 | 63 | 48 | 42 | 23 | 23 | 19 | 362 |
| Total Delvd. By 1st Sell-Out | 72 | 50 | 20 | 13 | 18 | 14 | 8 | 6 | 201 |
| % Distr. At 1st Sell-Out | 35.82 | 24.88 | 9.95 | 6.47 | 8.96 | 6.97 | 3.98 | 2.99 | 100 |
| Δ% > 2.08 | YES (LOW) | YES (LOW) | YES (HIGH) | YES (HIGH) | YES (HIGH) | NO | YES (HIGH) | YES (HIGH) | |
| Δ% > 4.17 | YES (LOW) | YES (LOW) | YES (HIGH) | YES (HIGH) | NO | NO | YES (HIGH) | YES (HIGH) | |
| Δ% > 6.25 | YES (LOW) | YES (LOW) | YES (HIGH) | NO | NO | NO | NO | NO | |
| Δ% > 8.33 | YES (LOW) | NO | NO | NO | NO | NO | NO | NO | |

Fig. 11

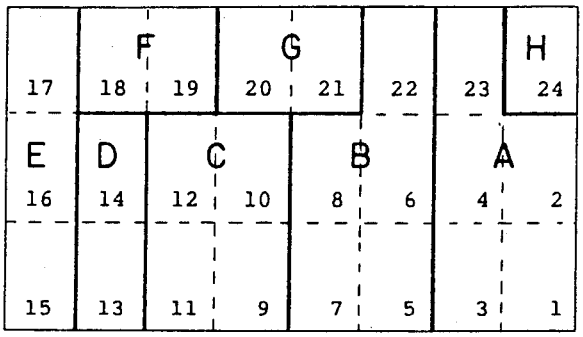

Fig. 12

| Selection | Total Capacity | Product Allocation % | Product Availability At Servicing |
|---|---|---|---|
| SELECTION A | 90 | 20.83 | EMPTY |
| SELECTION B | 90 | 20.83 | EMPTY |
| SELECTION C | 72 | 16.67 | 17 |
| SELECTION D | 36 | 8.33 | 2 |
| SELECTION E | 54 | 12.50 | 17 |
| SELECTION F | 36 | 8.33 | 10 |
| SELECTION G | 36 | 8.33 | 11 |
| SELECTION H | 18 | 4.17 | EMPTY |

Fig. 13

PRODUCT SALES ACTIVITY

| Product | A | B | C | D | E | F | G | H | Total |
|---|---|---|---|---|---|---|---|---|---|
| % Alloc. | 20.83 | 20.83 | 16.67 | 8.33 | 12.50 | 8.33 | 8.33 | 4.17 | 100 |
| Day 1 | 15 | 12 | 3 | 4 | 5 | 3 | 3 | 3 | 48 |
| Day 2 | 14 | 12 | 8 | 3 | 6 | 2 | 4 | 2 | 51 |
| Day 3 | 21 | 13 | 6 | 5 | 4 | 4 | 1 | 4 | 58 |
| Day 4 | 24 | 15 | 5 | 4 | 3 | 5 | 3 | 2 | 61 |
| Day 5 | 16 | 14 | 5 | 4 | 4 | 3 | 3 | 2 | |
| ----------1st Sell-Out---------- | | | | | | | | | |
| | 0 | 4 | 2 | 1 | 1 | 0 | 0 | 0 | 59 |
| Day 6 | 0 | 20 | 11 | 6 | 8 | 4 | 5 | 3 | 57 |
| Day 7 | 0 | 0 | 15 | 7 | 6 | 5 | 6 | 2 | 41 |
| Total Delvd. By Service Date | 90 | 90 | 55 | 34 | 37 | 26 | 25 | 18 | 375 |
| Total Delvd. By 1st Sell-Out | 90 | 66 | 27 | 20 | 22 | 17 | 14 | 13 | 269 |
| % Distr. At 1st Sell-Out | 33.46 | 24.54 | 10.04 | 7.43 | 8.18 | 6.32 | 5.20 | 4.83 | 100 |
| Δ% > 2.08 | YES (LOW) | YES (LOW) | YES (HIGH) | NO | YES (HIGH) | NO | YES (HIGH) | NO | |
| Δ% > 4.17 | YES (LOW) | NO | YES (HIGH) | NO | YES (HIGH) | NO | NO | NO | |
| Δ% > 6.25 | YES (LOW) | NO | YES (HIGH) | NO | NO | NO | NO | NO | |
| Δ% > 8.33 | YES (LOW) | NO | NO | NO | NO | NO | NO | NO | |

Fig. 14

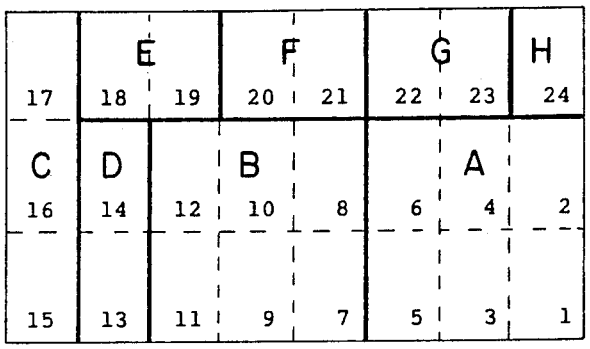

Fig. 15

| Selection | Total Capacity | Product Allocation % | Product Availability At Servicing |
|---|---|---|---|
| SELECTION A | 108 | 25.00 | EMPTY |
| SELECTION B | 108 | 25.00 | 5 |
| SELECTION C | 54 | 12.50 | 8 |
| SELECTION D | 36 | 8.33 | 6 |
| SELECTION E | 36 | 8.33 | EMPTY |
| SELECTION F | 36 | 8.33 | 9 |
| SELECTION G | 36 | 8.33 | 14 |
| SELECTION H | 18 | 4.17 | 1 |

Fig. 16

PRODUCT SALES ACTIVITY

| Product | A | B | C | D | E | F | G | H | Total |
|---|---|---|---|---|---|---|---|---|---|
| % Alloc. | 25.00 | 25.00 | 12.50 | 8.33 | 8.33 | 8.33 | 8.33 | 4.17 | 100 |
| Day 1 | 16 | 13 | 4 | 2 | 6 | 4 | 2 | 3 | 50 |
| Day 2 | 14 | 12 | 6 | 4 | 5 | 3 | 3 | 1 | 48 |
| Day 3 | 19 | 13 | 3 | 5 | 2 | 3 | 4 | 2 | 51 |
| Day 4 | 23 | 12 | 5 | 3 | 8 | 3 | 1 | 1 | 56 |
| Day 5 | 20 | 14 | 7 | 4 | 5 | 5 | 4 | 3 | 62 |
| Day 6 | 16 | 14 | 7 | 3 | 4 | 4 | 3 | 2 | |
| ----------1st Sell-Out---------- | | | | | | | | | |
| | 0 | 4 | 4 | 1 | 0 | 1 | 0 | 2 | 65 |
| Day 7 | 0 | 21 | 10 | 8 | 6 | 4 | 5 | 3 | 57 |
| Total Delvd. By Service Date | 108 | 103 | 46 | 30 | 36 | 27 | 22 | 17 | 389 |
| Total Delvd. By 1st Sell-Out | 108 | 78 | 32 | 21 | 30 | 22 | 17 | 12 | 320 |
| % Distr. At 1st Sell-Out | 33.75 | 24.38 | 10.00 | 6.56 | 9.38 | 6.88 | 5.31 | 3.75 | 100 |
| Δ% > 2.08 | YES (LOW) | NO | NO | NO | NO | NO | YES (HIGH) | NO | |
| Δ% > 4.17 | YES (LOW) | NO | NO | NO | NO | NO | NO | NO | |
| Δ% > 6.25 | YES (LOW) | NO | NO | NO | NO | NO | NO | NO | |
| Δ% > 8.33 | NO | NO | NO | NO | NO | NO | NO | NO | |

Fig. 17

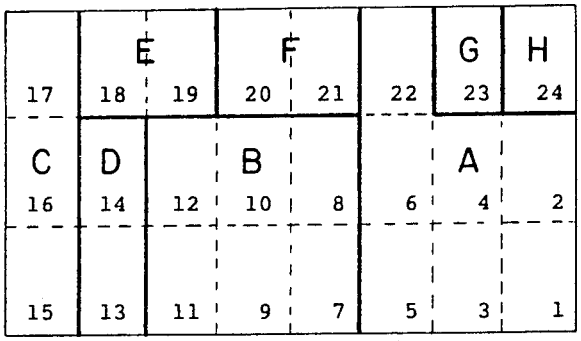

Fig. 18

| Selection | Total Capacity | Product Allocation % | Product Availability At Servicing |
|---|---|---|---|
| SELECTION A | 126 | 29.17 | EMPTY |
| SELECTION B | 108 | 25.00 | 10 |
| SELECTION C | 54 | 12.50 | 7 |
| SELECTION D | 36 | 8.33 | 7 |
| SELECTION E | 36 | 8.33 | EMPTY |
| SELECTION F | 36 | 8.33 | 12 |
| SELECTION G | 18 | 4.17 | EMPTY |
| SELECTION H | 18 | 4.17 | 2 |

Fig. 19

PRODUCT SALES ACTIVITY

| Product | A | B | C | D | E | F | G | H | Total |
|---|---|---|---|---|---|---|---|---|---|
| % Alloc. | 29.17 | 25.00 | 12.50 | 8.33 | 8.33 | 8.33 | 4.17 | 4.17 | 100 |
| Day 1 | 15 | 14 | 6 | 4 | 5 | 3 | 3 | 2 | 52 |
| Day 2 | 21 | 15 | 8 | 3 | 7 | 2 | 1 | 2 | 59 |
| Day 3 | 19 | 13 | 5 | 5 | 6 | 2 | 4 | 1 | 55 |
| Day 4 | 17 | 14 | 7 | 4 | 6 | 4 | 3 | 3 | 58 |
| Day 5 | 22 | 12 | 8 | 4 | 4 | 5 | 4 | 2 | 61 |
| Day 6 | 18 | 13 | 5 | 5 | 4 | 3 | 2 | 4 | 54 |
| Day 7 | 13 | 10 | 5 | 2 | 3 | 2 | 1 | 2 | |
| ----------1st Sell-Out---------- | | | | | | | | | |
| | 1 | 7 | 3 | 2 | 1 | 2 | 0 | 0 | 54 |
| Total Delvd. By Service Date | 126 | 98 | 47 | 29 | 36 | 23 | 18 | 16 | 393 |
| Total Delvd. By 1st Sell-Out | 125 | 91 | 44 | 27 | 35 | 21 | 17 | 16 | 376 |
| % Distr. At 1st Sell-Out | 33.24 | 24.20 | 11.70 | 7.18 | 9.31 | 5.59 | 4.52 | 4.26 | 100 |
| Δ% > 2.08 | YES (LOW) | NO | NO | NO | NO | YES (HIGH) | NO | NO | |
| Δ% > 4.17 | NO | NO | NO | NO | NO | NO | NO | NO | |
| Δ% > 6.25 | NO | NO | NO | NO | NO | NO | NO | NO | |
| Δ% > 8.33 | NO | NO | NO | NO | NO | NO | NO | NO | |

Fig. 20

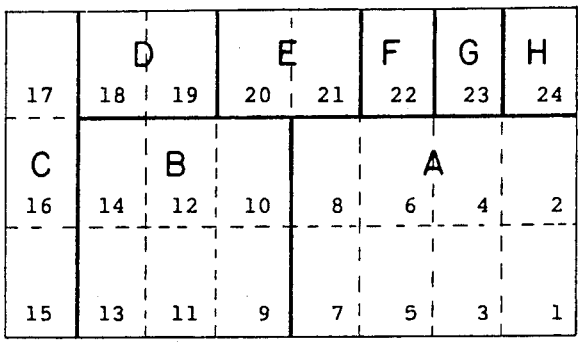

Fig. 21

| Selection | Total Capacity | Product Allocation % | Product Availability At Servicing |
|---|---|---|---|
| SELECTION A | 144 | 33.33 | EMPTY |
| SELECTION B | 108 | 25.00 | 3 |
| SELECTION C | 54 | 12.50 | 8 |
| SELECTION D | 36 | 8.33 | 6 |
| SELECTION E | 36 | 8.33 | EMPTY |
| SELECTION F | 18 | 4.17 | EMPTY |
| SELECTION G | 18 | 4.17 | EMPTY |
| SELECTION H | 18 | 4.17 | 2 |

Fig. 22

PRODUCT SALES ACTIVITY

| Product | A | B | C | D | E | F | G | H | Total |
|---|---|---|---|---|---|---|---|---|---|
| % Alloc. | 33.33 | 25.00 | 12.50 | 8.33 | 8.33 | 4.17 | 4.17 | 4.17 | 100 |
| Day 1 | 19 | 15 | 5 | 4 | 5 | 2 | 2 | 2 | 54 |
| Day 2 | 21 | 15 | 7 | 5 | 6 | 4 | 4 | 1 | 63 |
| Day 3 | 22 | 12 | 8 | 3 | 5 | 3 | 3 | 3 | 59 |
| Day 4 | 23 | 17 | 8 | 5 | 7 | 4 | 1 | 3 | 68 |
| Day 5 | 18 | 15 | 6 | 5 | 6 | 3 | 4 | 1 | 58 |
| Day 6 | 20 | 12 | 6 | 4 | 5 | 2 | 3 | 1 | |
| ----------1st Sell-Out---------- | | | | | | | | | |
| | 2 | 2 | 1 | 0 | 0 | 0 | 0 | 1 | 59 |
| Day 7 | 19 | 17 | 5 | 4 | 2 | 0 | 1 | 4 | 52 |
| Total Delvd. By Service Date | 144 | 105 | 46 | 30 | 36 | 18 | 18 | 16 | 413 |
| Total Delvd. By 1st Sell-Out | 123 | 86 | 40 | 26 | 34 | 18 | 17 | 11 | 355 |
| % Distr. At 1st Sell-Out | 34.65 | 24.23 | 11.27 | 7.32 | 9.58 | 5.07 | 4.79 | 3.10 | 100 |
| Δ% > 2.08 | NO | NO | NO | NO | NO | NO | NO | NO | |
| Δ% > 4.17 | NO | NO | NO | NO | NO | NO | NO | NO | |
| Δ% > 6.25 | NO | NO | NO | NO | NO | NO | NO | NO | |
| Δ% > 8.33 | NO | NO | NO | NO | NO | NO | NO | NO | |

Fig. 23

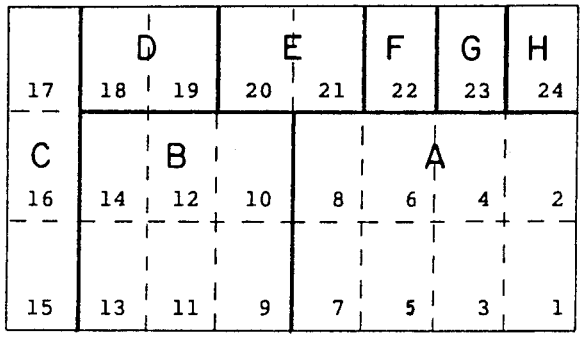

Fig. 24

| Selection | Total Capacity | Product Allocation % | Product Availability At Servicing |
|---|---|---|---|
| SELECTION A | 144 | 33.33 | 4 |
| SELECTION B | 108 | 25.00 | 4 |
| SELECTION C | 54 | 12.50 | 9 |
| SELECTION D | 36 | 8.33 | 6 |
| SELECTION E | 36 | 8.33 | EMPTY |
| SELECTION F | 18 | 4.17 | EMPTY |
| SELECTION G | 18 | 4.17 | 1 |
| SELECTION H | 18 | 4.17 | EMPTY |

Fig. 25

PRODUCT SALES ACTIVITY

| Product | A | B | C | D | E | F | G | H | Total |
|---|---|---|---|---|---|---|---|---|---|
| % Alloc. | 33.33 | 25.00 | 12.50 | 8.33 | 8.33 | 4.17 | 4.17 | 4.17 | 100 |
| Day 1 | 17 | 14 | 6 | 4 | 5 | 2 | 2 | 2 | 52 |
| Day 2 | 21 | 17 | 7 | 5 | 7 | 3 | 3 | 3 | 66 |
| Day 3 | 20 | 13 | 7 | 3 | 6 | 3 | 2 | 3 | 57 |
| Day 4 | 22 | 16 | 9 | 4 | 6 | 4 | 3 | 3 | 67 |
| Day 5 | 19 | 14 | 5 | 5 | 5 | 3 | 2 | 2 | 55 |
| Day 6 | 16 | 12 | 5 | 5 | 4 | 3 | 3 | 3 | |
| ----------1st Sell-Out---------- | | | | | | | | | |
| | 3 | 2 | 1 | 0 | 1 | 0 | 0 | 0 | 58 |
| Day 7 | 22 | 16 | 5 | 4 | 2 | 0 | 2 | 2 | 53 |
| Total Delvd. By Service Date | 140 | 104 | 45 | 30 | 36 | 18 | 17 | 18 | 408 |
| Total Delvd. By 1st Sell-Out | 115 | 86 | 39 | 26 | 33 | 18 | 15 | 16 | 348 |
| % Distr. At 1st Sell-Out | 33.05 | 24.71 | 11.21 | 7.47 | 9.48 | 5.17 | 4.31 | 4.60 | 100 |
| Δ% > 2.08 | NO | NO | NO | NO | NO | NO | NO | NO | |
| Δ% > 4.17 | NO | NO | NO | NO | NO | NO | NO | NO | |
| Δ% > 6.25 | NO | NO | NO | NO | NO | NO | NO | NO | |
| Δ% > 8.33 | NO | NO | NO | NO | NO | NO | NO | NO | |

Fig. 26

PRODUCT SALES ACTIVITY

| Product | A | B | C | D | E | F | G | H | Total |
|---|---|---|---|---|---|---|---|---|---|
| Number of Storage Areas Allocated | 4 | 4 | 4 | 3 | 3 | 2 | 2 | 2 | 24 |
| Product Capacity | 72 | 72 | 72 | 54 | 54 | 36 | 36 | 36 | $P_{tc}$= 432 |
| % Alloc. | 16.67 | 16.67 | 16.67 | 12.50 | 12.50 | 8.33 | 8.33 | 8.33 | 100 |
| Day 1 | 16 | 14 | 4 | 5 | 4 | 2 | 4 | 0 | 49 |
| Day 2 | 22 | 12 | 7 | 2 | 3 | 4 | 2 | 1 | 53 |
| Day 3 | 21 | 13 | 5 | 3 | 7 | 5 | 1 | 3 | 58 |
| Day 4 | 13 | 11 | 4 | 3 | 4 | 3 | 1 | 2 | |
| ----------1st Sell-Out---------- | | | | | | | | | |
| | 0 | 6 | 4 | 3 | 2 | 0 | 2 | 1 | 59 |
| Day 5 | 0 | 16 | 10 | 16 | 7 | 1 | 6 | 4 | 60 |
| Day 6 | 0 | 0 | 15 | 9 | 7 | 4 | 3 | 4 | 42 |
| Day 7 | 0 | 0 | 14 | 7 | 8 | 4 | 4 | 4 | 41 |
| Total Delvd. By Service Date | 72 | 72 | 63 | 48 | 42 | 23 | 23 | 19 | 362 |
| $P_{demand(n)}$ | 72 | 50 | 20 | 13 | 18 | 14 | 8 | $P_{demand(t)}$= 6 | 201 |
| %dist(n) | 35.82 | 24.88 | 9.95 | 6.47 | 8.96 | 6.97 | 3.98 | 2.99 | 100 |
| $S_n$ | 8.60 | 5.97 | 2.39 | 1.55 | 2.15 | 1.67 | .96 | .72 | |
| Rounded Off $S_n$ | 9 | 6 | 2 | 2 | 2 | 2 | 1 | 1 | 25 |
| Adjusted $S_n$ | 9 | 6 | 2 | 1 | 2 | 2 | 1 | 1 | 24 |

where $S_n = [\%dist(n) \times P_{tc}]/C$, and 1. n varies between A and H,
2. $S_n$ refers to the desired storage area distribution count for product n,
3. $P_{tc}$ refers to total product capacity of the vend system,
4. C = 18, and refers to the capacity of the individual storage areas,
5. %dist(n) refers to the percentage distribution of product n by demand at first product sell-out, i.e., $\%dist(n) = P_{demand(n)}/P_{demand(t)}$, where a. $P_{demand(n)}$ refers to the demand for product n to first product sell-out
   b. $P_{demand(t)}$ refers to total product demand for all products to first product sell-out.

Fig. 27

PRODUCT SALES ACTIVITY

| Product | A | B | C | D | E | F | G | H | Total |
|---|---|---|---|---|---|---|---|---|---|
| Number of Storage Areas Allocated | 5 | 5 | 4 | 2 | 3 | 2 | 2 | 1 | 24 |
| Product Capacity | 90 | 90 | 72 | 36 | 54 | 36 | 36 | 18 | $P_{tc}$= 432 |
| % Alloc. | 20.83 | 20.83 | 16.67 | 8.33 | 12.50 | 8.33 | 8.33 | 4.17 | 100 |
| Day 1 | 15 | 12 | 3 | 4 | 5 | 3 | 3 | 3 | 48 |
| Day 2 | 14 | 12 | 8 | 3 | 6 | 2 | 4 | 2 | 51 |
| Day 3 | 21 | 13 | 6 | 5 | 4 | 4 | 1 | 4 | 58 |
| Day 4 | 24 | 15 | 5 | 4 | 3 | 5 | 3 | 2 | 61 |
| Day 5 | 16 | 14 | 5 | 4 | 4 | 3 | 3 | 2 | |
| ----------1st Sell-Out---------- | | | | | | | | | |
| | 0 | 4 | 2 | 1 | 1 | 0 | 0 | 0 | 59 |
| Day 6 | 0 | 20 | 11 | 6 | 8 | 4 | 5 | 3 | 57 |
| Day 7 | 0 | 0 | 15 | 7 | 6 | 5 | 6 | 2 | 41 |
| Total Delvd. By Service Date | 90 | 90 | 55 | 34 | 37 | 26 | 25 | 18 | 375 |
| $P_{demand(n)}$ | 90 | 66 | 27 | 20 | 22 | 17 | 14 | 13 | $P_{demand(t)}$= 269 |
| %dist(n) | 33.46 | 24.54 | 10.04 | 7.43 | 8.18 | 6.32 | 5.20 | 4.83 | 100 |
| $S_n$ | 8.03 | 5.89 | 2.41 | 1.78 | 1.96 | 1.52 | 1.25 | 1.16 | |
| Rounded Off $S_n$ | 8 | 6 | 2 | 2 | 2 | 2 | 1 | 1 | 24 |

where $S_n$ = [%dist(n) x $P_{tc}$]/C, and 1. n varies between A and H,
2. $S_n$ refers to the desired storage area distribution count for product n,
3. $P_{tc}$ refers to total product capacity of the vend system,
4. C = 18, and refers to the capacity of the individual storage areas,
5. %dist(n) refers to the percentage distribution of product n by demand at first product sell-out, i.e., %dist(n) = $P_{demand(n)}/P_{demand(t)}$, where a. $P_{demand(n)}$ refers to the demand for product n to first product sell-out b. $P_{demand(t)}$ refers to total product demand for all products to first product sell-out.

Fig. 28

PRODUCT SALES ACTIVITY

| Product | A | B | C | D | E | F | G | H | Total |
|---|---|---|---|---|---|---|---|---|---|
| Number of Storage Areas Allocated | 6 | 6 | 3 | 2 | 2 | 2 | 2 | 1 | 24 |
| Product Capacity | 108 | 108 | 54 | 36 | 36 | 36 | 36 | 18 | $P_{tc}$= 432 |
| % Alloc. | 25.00 | 25.00 | 12.50 | 8.33 | 8.33 | 8.33 | 8.33 | 4.17 | 100 |
| Day 1 | 16 | 13 | 4 | 2 | 6 | 4 | 2 | 3 | 50 |
| Day 2 | 14 | 12 | 6 | 4 | 5 | 3 | 3 | 1 | 48 |
| Day 3 | 19 | 13 | 3 | 5 | 2 | 3 | 4 | 2 | 51 |
| Day 4 | 23 | 12 | 5 | 3 | 8 | 3 | 1 | 1 | 56 |
| Day 5 | 20 | 14 | 7 | 4 | 5 | 5 | 4 | 3 | 62 |
| Day 6 | 16 | 14 | 7 | 3 | 4 | 4 | 3 | 2 | |
| ----------1st Sell-Out---------- | | | | | | | | | |
| | 0 | 4 | 4 | 1 | 0 | 1 | 0 | 2 | 65 |
| Day 7 | 0 | 21 | 10 | 8 | 6 | 4 | 5 | 3 | 57 |
| Total Delvd. By Service Date | 108 | 103 | 46 | 30 | 36 | 27 | 22 | 17 | 389 |
| $P_{demand(n)}$ | 108 | 78 | 32 | 21 | 30 | 22 | 17 | 12 | $P_{demand(t)}$= 320 |
| $\%_{dist(n)}$ | 33.75 | 24.38 | 10.00 | 6.56 | 9.38 | 6.88 | 5.31 | 3.75 | 100 |
| $S_n$ | 8.10 | 5.85 | 2.40 | 1.57 | 2.25 | 1.65 | 1.27 | .90 | |
| Rounded Off $S_n$ | 8 | 6 | 2 | 2 | 2 | 2 | 1 | 1 | 24 |

where $S_n = [\%_{dist(n)} \times P_{tc}]/C$, and 1. n varies between A and H,
2. $S_n$ refers to the desired storage area distribution count for product n,
3. $P_{tc}$ refers to total product capacity of the vend system,
4. C = 18, and refers to the capacity of the individual storage areas,
5. $\%_{dist(n)}$ refers to the percentage distribution of product n by demand at first product sell-out, i.e., $\%_{dist(n)} = P_{demand(n)}/P_{demand(t)}$, where a. $P_{demand(n)}$ refers to the demand for product n to first product sell-out
   b. $P_{demand(t)}$ refers to total product demand for all products to first product sell-out.

Fig. 29

PRODUCT SALES ACTIVITY

| Product | A | B | C | D | E | F | G | H | Total |
|---|---|---|---|---|---|---|---|---|---|
| Number of Storage Areas Allocated | 7 | 6 | 3 | 2 | 2 | 2 | 1 | 1 | 24 |
| Product Capacity | 126 | 108 | 54 | 36 | 36 | 36 | 18 | 18 | $P_{tc}$= 432 |
| % Alloc. | 29.17 | 25.00 | 12.50 | 8.33 | 8.33 | 8.33 | 4.17 | 4.17 | 100 |
| Day 1 | 15 | 14 | 6 | 4 | 5 | 3 | 3 | 2 | 52 |
| Day 2 | 21 | 15 | 8 | 3 | 7 | 2 | 1 | 2 | 59 |
| Day 3 | 19 | 13 | 5 | 5 | 6 | 2 | 4 | 1 | 55 |
| Day 4 | 17 | 14 | 7 | 4 | 6 | 4 | 3 | 3 | 58 |
| Day 5 | 22 | 12 | 8 | 4 | 4 | 5 | 4 | 2 | 61 |
| Day 6 | 18 | 13 | 5 | 5 | 4 | 3 | 2 | 4 | 54 |
| Day 7 | 13 | 10 | 5 | 2 | 3 | 2 | 1 | 2 | |
| ----------1st Sell-Out---------- | | | | | | | | | |
| | 1 | 7 | 3 | 2 | 1 | 2 | 0 | 0 | 54 |
| Total Delvd. By Service Date | 126 | 98 | 47 | 29 | 36 | 23 | 18 | 16 | 393 |
| $P_{demand(n)}$ | 125 | 91 | 44 | 27 | 35 | 21 | 17 | 16 | $P_{demand(t)}$= 376 |
| %dist(n) | 33.24 | 24.20 | 11.70 | 7.18 | 9.31 | 5.59 | 4.52 | 4.26 | 100 |
| $S_n$ | 7.98 | 5.81 | 2.81 | 1.72 | 2.23 | 1.34 | 1.08 | 1.02 | |
| Rounded Off $S_n$ | 8 | 6 | 3 | 2 | 2 | 1 | 1 | 1 | 24 |

where $S_n = [\%dist(n) \times P_{tc}]/C$, and 1. n varies between A and H,
2. $S_n$ refers to the desired storage area distribution count for product n,
3. $P_{tc}$ refers to total product capacity of the vend system,
4. C = 18, and refers to the capacity of the individual storage areas,
5. %dist(n) refers to the percentage distribution of product n by demand at first product sell-out, i.e., $\%dist(n) = P_{demand(n)}/P_{demand(t)}$, where a. $P_{demand(n)}$ refers to the demand for product n to first product sell-out
   b. $P_{demand(t)}$ refers to total product demand for all products to first product sell-out.

Fig. 30

PRODUCT SALES ACTIVITY

| Product | A | B | C | D | E | F | G | H | Total |
|---|---|---|---|---|---|---|---|---|---|
| Number of Storage Areas Allocated | 8 | 6 | 3 | 2 | 2 | 1 | 1 | 1 | 24 |
| Product Capacity | 144 | 108 | 54 | 36 | 36 | 18 | 18 | 18 | $P_{tc}$= 432 |
| % Alloc. | 33.33 | 25.00 | 12.50 | 8.33 | 8.33 | 4.17 | 4.17 | 4.17 | 100 |
| Day 1 | 19 | 15 | 5 | 4 | 5 | 2 | 2 | 2 | 54 |
| Day 2 | 21 | 15 | 7 | 5 | 6 | 4 | 4 | 1 | 63 |
| Day 3 | 22 | 12 | 8 | 3 | 5 | 3 | 3 | 3 | 59 |
| Day 4 | 23 | 17 | 8 | 5 | 7 | 4 | 1 | 3 | 68 |
| Day 5 | 18 | 15 | 6 | 5 | 6 | 3 | 4 | 1 | 58 |
| Day 6 | 20 | 12 | 6 | 4 | 5 | 2 | 3 | 1 | |
| ----------1st Sell-Out---------- | | | | | | | | | |
| | 2 | 2 | 1 | 0 | 0 | 0 | 0 | 1 | 59 |
| Day 7 | 19 | 17 | 5 | 4 | 2 | 0 | 1 | 4 | 52 |
| Total Delvd. By Service Date | 144 | 105 | 46 | 30 | 36 | 18 | 18 | 16 | 413 |
| $P_{demand(n)}$ | 123 | 86 | 40 | 26 | 34 | 18 | 17 | 11 | $P_{demand(t)}$= 355 |
| $\%_{dist(n)}$ | 34.65 | 24.23 | 11.27 | 7.32 | 9.58 | 5.07 | 4.79 | 3.10 | 100 |
| $S_n$ | 8.31 | 5.82 | 2.70 | 1.76 | 2.30 | 1.22 | 1.15 | .74 | |
| Rounded Off $S_n$ | 8 | 6 | 3 | 2 | 2 | 1 | 1 | 1 | 24 |

where $S_n = [\%_{dist(n)} \times P_{tc}]/C$, and 1. n varies between A and H,
2. $S_n$ refers to the desired storage area distribution count for product n,
3. $P_{tc}$ refers to total product capacity of the vend system,
4. C = 18, and refers to the capacity of the individual storage areas,
5. $\%_{dist(n)}$ refers to the percentage distribution of product n by demand at first product sell-out, i.e., $\%_{dist(n)} = P_{demand(n)}/P_{demand(t)}$, where a. $P_{demand(n)}$ refers to the demand for product n to first product sell-out b. $P_{demand(t)}$ refers to total product demand for all products to first product sell-out.

Fig. 31

PRODUCT SALES ACTIVITY

| Product | A | B | C | D | E | F | G | H | Total |
|---|---|---|---|---|---|---|---|---|---|
| Number of Storage Areas Allocated | 8 | 6 | 3 | 2 | 2 | 1 | 1 | 1 | 24 |
| Product Capacity | 144 | 108 | 54 | 36 | 36 | 18 | 18 | 18 | $P_{tc}$= 432 |
| % Alloc. | 33.33 | 25.00 | 12.50 | 8.33 | 8.33 | 4.17 | 4.17 | 4.17 | 100 |
| Day 1 | 17 | 14 | 6 | 4 | 5 | 2 | 2 | 2 | 52 |
| Day 2 | 21 | 17 | 7 | 5 | 7 | 3 | 3 | 3 | 66 |
| Day 3 | 20 | 13 | 7 | 3 | 6 | 3 | 2 | 3 | 57 |
| Day 4 | 22 | 16 | 9 | 4 | 6 | 4 | 3 | 3 | 67 |
| Day 5 | 19 | 14 | 5 | 5 | 5 | 3 | 2 | 2 | 55 |
| Day 6 | 16 | 12 | 5 | 5 | 4 | 3 | 3 | 3 | |
| ----------1st Sell-Out---------- | | | | | | | | | |
| | 3 | 2 | 1 | 0 | 1 | 0 | 0 | 0 | 58 |
| Day 7 | 22 | 16 | 5 | 4 | 2 | 0 | 2 | 2 | 53 |
| Total Delvd. By Service Date | 140 | 104 | 45 | 30 | 36 | 18 | 17 | 18 | 408 |
| $P_{demand(n)}$ | 115 | 86 | 39 | 26 | 33 | 18 | 15 | 16 | $P_{demand(t)}$= 348 |
| %dist(n) | 33.05 | 24.71 | 11.21 | 7.47 | 9.48 | 5.17 | 4.31 | 4.60 | 100 |
| $S_n$ | 7.93 | 5.93 | 2.69 | 1.79 | 2.28 | 1.24 | 1.03 | 1.10 | |
| Rounded Off $S_n$ | 8 | 6 | 3 | 2 | 2 | 1 | 1 | 1 | 24 |

where $S_n = [\%dist(n) \times P_{tc}]/C$, and 1. n varies between A and H,
2. $S_n$ refers to the desired storage area distribution count for product n,
3. $P_{tc}$ refers to total product capacity of the vend system,
4. C = 18, and refers to the capacity of the individual storage areas,
5. %dist(n) refers to the percentage distribution of product n by demand at first product sell-out, i.e., $\%dist(n) = P_{demand(n)}/P_{demand(t)}$, where a. $P_{demand(n)}$ refers to the demand for product n to first product sell-out b. $P_{demand(t)}$ refers to total product demand for all products to first product sell-out.

Fig. 32

| | | | | | | | |
|---|---|---|---|---|---|---|---|
| --17 | --18 | --19 | --20 | --21 | --22 | --23 | --24 |
| --16 | --14 | --12 | --10 | —8 | —6 | —4 | —2 |
| --15 | --13 | --11 | --9 | —7 | —5 | —3 | —1 |

| | | | | | | | |
|---|---|---|---|---|---|---|---|
| --17 | --18 | --19 | --20 | --21 | --22 | --23 | --24 |
| --16 | —14 | —12 | —10 | --8 | --6 | --4 | --2 |
| --15 | —13 | —11 | —9 | --7 | --5 | --3 | --1 |

| | | | | | | | |
|---|---|---|---|---|---|---|---|
| —17 | --18 | --19 | --20 | --21 | --22 | --23 | --24 |
| —16 | --14 | --12 | --10 | --8 | --6 | --4 | --2 |
| —15 | --13 | --11 | --9 | --7 | --5 | --3 | --1 |

| | | | | | | | |
|---|---|---|---|---|---|---|---|
| --17 | —18 | —19 | --20 | --21 | --22 | --23 | --24 |
| --16 | --14 | --12 | --10 | --8 | --6 | --4 | --2 |
| --15 | --13 | --11 | --9 | --7 | --5 | --3 | --1 |

| | | | | | | | |
|---|---|---|---|---|---|---|---|
| --17 | --18 | --19 | —20 | —21 | --22 | --23 | --24 |
| --16 | --14 | --12 | --10 | --8 | --6 | --4 | --2 |
| --15 | --13 | --11 | --9 | --7 | --5 | --3 | --1 |

| | | | | | | | |
|---|---|---|---|---|---|---|---|
| --17 | --18 | --19 | --20 | --21 | —22 | --23 | --24 |
| --16 | --14 | --12 | --10 | --8 | --6 | --4 | --2 |
| --15 | --13 | --11 | --9 | --7 | --5 | --3 | --1 |

| | | | | | | | |
|---|---|---|---|---|---|---|---|
| --17 | --18 | --19 | --20 | --21 | --22 | —23 | --24 |
| --16 | --14 | --12 | --10 | --8 | --6 | --4 | --2 |
| --15 | --13 | --11 | --9 | --7 | --5 | --3 | --1 |

| | | | | | | | |
|---|---|---|---|---|---|---|---|
| --17 | --18 | --19 | --20 | --21 | --22 | --23 | —24 |
| --16 | --14 | --12 | --10 | --8 | --6 | --4 | --2 |
| --15 | --13 | --11 | --9 | --7 | --5 | --3 | --1 |

| Product | Percentage Distribution Of Product By 1st Product Sell-out [%dist(n)] (from Fig. 27) | Product Storage Allocation Configuration Percentage |
|---|---|---|
| A | 35.82 | 35.42 |
| B | 24.88 | 23.61 |
| C | 9.95 | 12.50 |
| D | 6.47 | 6.25 |
| E | 8.96 | 7.64 |
| F | 6.97 | 6.25 |
| G | 3.98 | 4.86 |
| H | 2.99 | 3.47 |

| Product | Percentage Distribution Of Product By 1st Product Sell-out [%dist(n)] (from Fig. 32) | Product Storage Allocation Configuration Percentage |
|---|---|---|
| A | 33.05 | 32.64 |
| B | 24.71 | 25.00 |
| C | 11.21 | 12.50 |
| D | 7.47 | 7.64 |
| E | 9.48 | 9.03 |
| F | 5.17 | 4.86 |
| G | 4.31 | 3.47 |
| H | 4.60 | 4.86 |

Percentage Distributions Of Individual Storage Areas

| | | | |
|---|---|---|---|
| Column 9 | 4.17 % | Area a of column x | 1.16 % |
| Column 10 | 4.17 % | Area b of column x | .46 % |
| Column 20 | 4.17 % | Area c of column x | .46 % |
| | | Area d of column x | .46 % |
| | | Area e of column x | 1.62 % |

Preferred Product Storage Allocation Configuration

| Product | Compartment | Product | Compartment |
|---|---|---|---|
| A | 7-12, 19-20, and 18c-e | E | 15-16 |
| B | 1-6 | F | 21 and 22c-e |
| C | 13-14 and 18a-b | G | 17 |
| D | 24 and 23c-e | H | 22a-b and 23a-b |

Preferred Product Storage Allocation Configuration

| Product | Compartment | Product | Compartment |
|---|---|---|---|
| A | 1-8 | E | 15-16 and 17a |
| B | 9-14 | F | 20 and 21a |
| C | 18-19 and 17b-e | G | 23 |
| D | 22 and 21b-e | H | 24 |

VEND SPACE ALLOCATION MEANS AND METHOD

BACKGROUND OF THE INVENTION

The present invention relates to a vend space allocation means and method, and, more particularly, to a means and method for determining, based upon historical demand for the various vend product selections, a vend space allocation configuration for a given vend system that has a plurality of allocatable vend product storage areas. Such vend space allocation means and method are particularly useful with vend systems for selectively dispensing or vending several different types of products from product storage columns, especially for products that are of generally cylindrical configurations, such as bottles or cans, and with vend systems that have a greater number of allocatable vend product storage areas than vend product selections.

Over the years a variety of approaches have been utilized in attempts to match product stocking of a vending machine to the perceived demand for the various products to be vended therefrom. Among such approaches have been the use of multiple columns with their associated selection and product delivery means for vending major products and single columns with their associated selection and product delivery means for vending secondary products, the use of multiple columns with common selection and/or product delivery means for vending major products and single columns with their associated selection and product delivery means for vending secondary products, the use of differently sized columns to permit the stacking of cans or like items in double as opposed to single stacks, the use of half-height columns which permits secondary products to be stored in such smaller sized columns while major products are stored in full-height columns that may open out above the half-height columns, the use of columns of staggered heights with inclined racks or other storage areas above selected ones of the staggered height columns to obtain product storage compartments of varying capacities, and the use of column transfer means such as column transfer shelves, gates, and trap doors which permit those products stored above a certain level in one column to be transferred into another column for vending therefrom, some of which approaches have permitted service personnel, at the time of restocking of a particular vending machine, to set, adjust, or re-position certain elements in such particular vending machine so that the product storage therein will more closely match the empirical demand for products observed by such service personnel.

Patents such as U.S. Pat. Nos. 4,245,755; 4,699,295; and 4,705,176 all discuss the difficulties and history of trying to develop vending systems wherein product storage space can be optimally allocated to the various product types that are desired to be vended therefrom, and all illustrate approaches to the Problem of space to sales allocation. While there has been considerable work devoted to the design of vending machines that will permit optimal allocation of product storage space to anticipated product demand and considerable discussion regarding the desirability of matching the product stocking of a vending machine to the sales therefrom, there has beer little discussion regarding the manner in which it is determined whether or to what extent a particular space to sales allocation scheme is acceptable in light of the actual historical demand for the various types of products, and, if such allocation scheme is not acceptable, how a more appropriate allocation scheme can be effected.

In many instances product demand may vary from location to location and machine to machine. While pre-established space to sales configurations may be established based upon national or regional statistics regarding the relative popularity of various products desired to be vended from a particular machine, it often falls upon the service personnel to determine from their observations when servicing a machine how closely the anticipated product demand corresponds to sales from that machine. If one or more types of product are consistently sold out every time the machine is serviced while other types of product remain available in abundance, the particular space to sales allocation scheme being employed is clearly not appropriate. Because of the obvious inappropriateness of the space to sales allocation scheme most service personnel would recognize the desirability of attempting in some way to compensate for or to revise or tailor the space to sales allocation scheme. Some of the tricks of the trade that may be employed by the service personnel are discussed in U.S. Pat. No. 4,705,176. In certain instances, if the product storage areas of the machine are susceptible to reallocation among the various types of vend products, it may then be possible to reconfigure product storage by repositioning certain column transfer elements or other reconfiguration means to obtain a reallocation of vend product storage among the various types of vend products. One of the difficulties faced by service personnel, however, is the determination of what product storage allocation scheme should be established in any particular instance. While service personnel may attempt to base such determination upon their observations regarding the perceived relative popularity of the vend products, subjective biases of such service personnel can often easily influence such determination. Moreover, while obvious mismatch conditions may be determinable by service personnel from their observations upon servicing the machine, less obvious mismatch conditions can easily, and often do, escape recognition by even the most observant service personnel over extended periods of time. Regardless of whether such mismatch conditions are obvious or not, reconfiguration determinations often come down to subjective decisions by service personnel, many of which decisions are little better than hunches or guesses by such service personnel.

Applicant's co-pending U.S. Pat. application Ser. No. 303,547, filed Jan. 27, 1989, discloses and teaches a means and method for monitoring product demand over a period of time and for determining, based upon such product demand, whether an established vend space allocation configuration for the vend system is consistent with such product demand. As is described and explained in such application, with some embodiments thereof, especially those embodiments wherein a significant amount of result data indicative of the degree of deviation between vend product space allocated and product demand is provided, authorized personnel can generally arrive at reconfiguration determinations whose vend product allocations more closely match actual product demand. Even with such vend selection monitor means and method, however, the authorized personnel must make subjective determinations based upon the information made available to them.

The present invention therefore is a refinement of and improvement over the invention of Applicant's copending U.S. Pat. application Ser. No. 303,547, filed Jan. 27, 1989, in that it provides for the objective determination of a preferred, optimized vend product storage allocation configuration based, at least in part, upon the historical product demand over a period of time and for communication of such objective determination to the authorized personnel so that they can effect a reconfiguration of the vend product storage allocation if they so desire and if reconfiguration is necessary to more closely match vend product storage to product demand.

SUMMARY OF THE INVENTION

The present invention is thus designed as a vend space allocation means and method that can be employed to objectively determine space allocation information indicative of a preferred vend product storage allocation configuration for a vending system based upon the historical demand for products vended by such vending system. Such vend space allocation means is intended for use with a vending system that is capable of vending from among a plurality of classes of selectable vendable products a product from a selected product class, which vending system has a plurality of allocatable vend product storage areas and an established vend space allocation configuration allocating the product storage areas to the classes of selectable vendable products, and includes a vend selection monitoring means for monitoring over a period of time the historical demand for the various classes of selectable vendable products, means for determining, based at least in part upon such historical demand, space allocation information indicative of a preferred vend space allocation configuration, and means for communicating to authorized personnel such determination. Such means for determining space allocation information indicative of a preferred vend space allocation configuration typically includes a processing means operable to determine for each class of selectable vendable products a proportionate demand value based upon the historical demand for such class of products and to determine from such proportionate demand values and from system design data for the particular vending system space allocation information indicative of a preferred vend product storage allocation configuration for such vending system. In more basic systems, especially in systems whose vending machines are designed to employ a plurality of like-sized storage areas for product storage, the space allocation information communicated to authorized personnel may take the form of desired storage area counts for the various classes of selectable vendable products, while in more advanced systems the space allocation information may take the form of a specified allocation of product storage areas of the vending system among the various classes of selectable vendable products.

It is thus a principal object of the invention to provide a means and method for determining a preferred vend space allocation configuration for a multi-selection vending system based upon historical demand for the various product selections.

Various other objects and advantages of the present invention will also become apparent to those skilled in the art after considering the following detailed specification in conjunction with the accompanying drawings, wherein:

BRIEF DESCRIPTION OF THE DRAWINGS

FIGS. 9, 12, 15, 18, 21, and 24 represent various allocation configurations of a vending machine constructed in accordance with FIGS. 1 and 7.

FIGS. 10, 13, 16, 19, 22, and 25 are tables containing information pertinent, respectively, to FIGS. 9, 12, 15, 18, 21, and 24, including information identifying typical product availability status for the various product classes at the time of vending machine servicing.

FIGS. 11, 14, 17, 20″ 23, and 26 are associated, respectively, with FIGS. 9, 12, 15, 18, 21, and 24, and also with FIGS. 10, 13, 16, 19, 22, and 25, and illustrate both typical vend activity over one service period of a vending machine having product allocation configurations as represented by FIGS. 9, 12, 15, 18, 21, and 24, respectively, which vend activity results in the product availability status set forth in (FIGS. 10, 13, 16, 19, 22, and 25, respectively, and how the product demand during such service period can be utilized to determine whether the Particular product allocation configuration is acceptable or may require revision.

FIGS. 27–32 are tables that are associated, respectively, with FIGS. 11, 14, 17, 20, 23, and 26, and their associated figures, and which illustrate both typical vend activity over one service period of a vending machine having product allocation configurations as represented by FIGS. 9, 12, 15, 18, 21, and 24, respectively, which vend activity results in the product availability status set forth in FIGS. 10, 13, 16, 19, 22, and 25, respectively, and determinations based upon the monitored historical product demand values as well as the total capacity of the vending machine and the capacity of the individual storage areas of the vending machine such that desired storage area distribution counts can be calculated for each of the products.

DETAILED DESCRIPTION OF PREFERRED EMBODIMENTS

Figure 1:
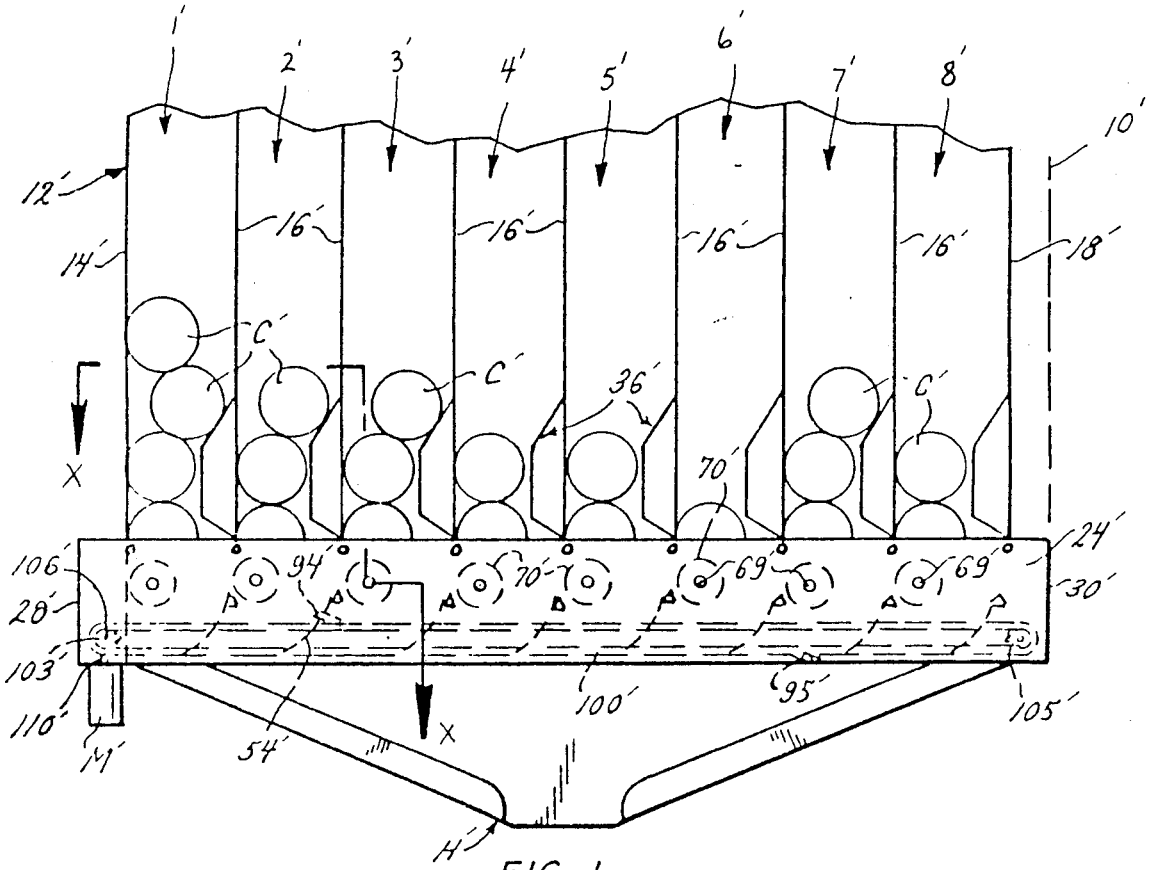
FIG. 1 is a schematic front view of the lower portion of a vending machine having a columnar product feed to the product delivery mechanism.

Referring now to the drawings, wherein like reference numbers refer to like items, FIGS. 1-26 and 66-67 of this application correspond, respectively, to FIGS. 1-26 and 28-29 of Applicant's co-pending U.S. Pat. application Ser. No. 303,547, filed Jan. 27, 1989, and FIGS. 1, 5, 6, and 7 of this application also correspond, respectively, to FIGS. 1, 3, 12, and of Applicant's co-pending U.S. Pat. application No. 230,963, now U.S. Pat. No. 4,991,739, both of which applications are also assigned to Applicant's assignee. All reference numbers in the present application which include as part of the number the prime symbol (') correspond to like non-prime reference numbers in U.S. Pat. application Ser. No. 230,963, now U.S. Pat. No. 4,991,739, and identify elements the descriptions of which and discussions about which in U.S. Pat. application Ser. No. 230,963, now U.S. Pat. No. 4,991,739, are incorporated herein by reference.

Figure 5:
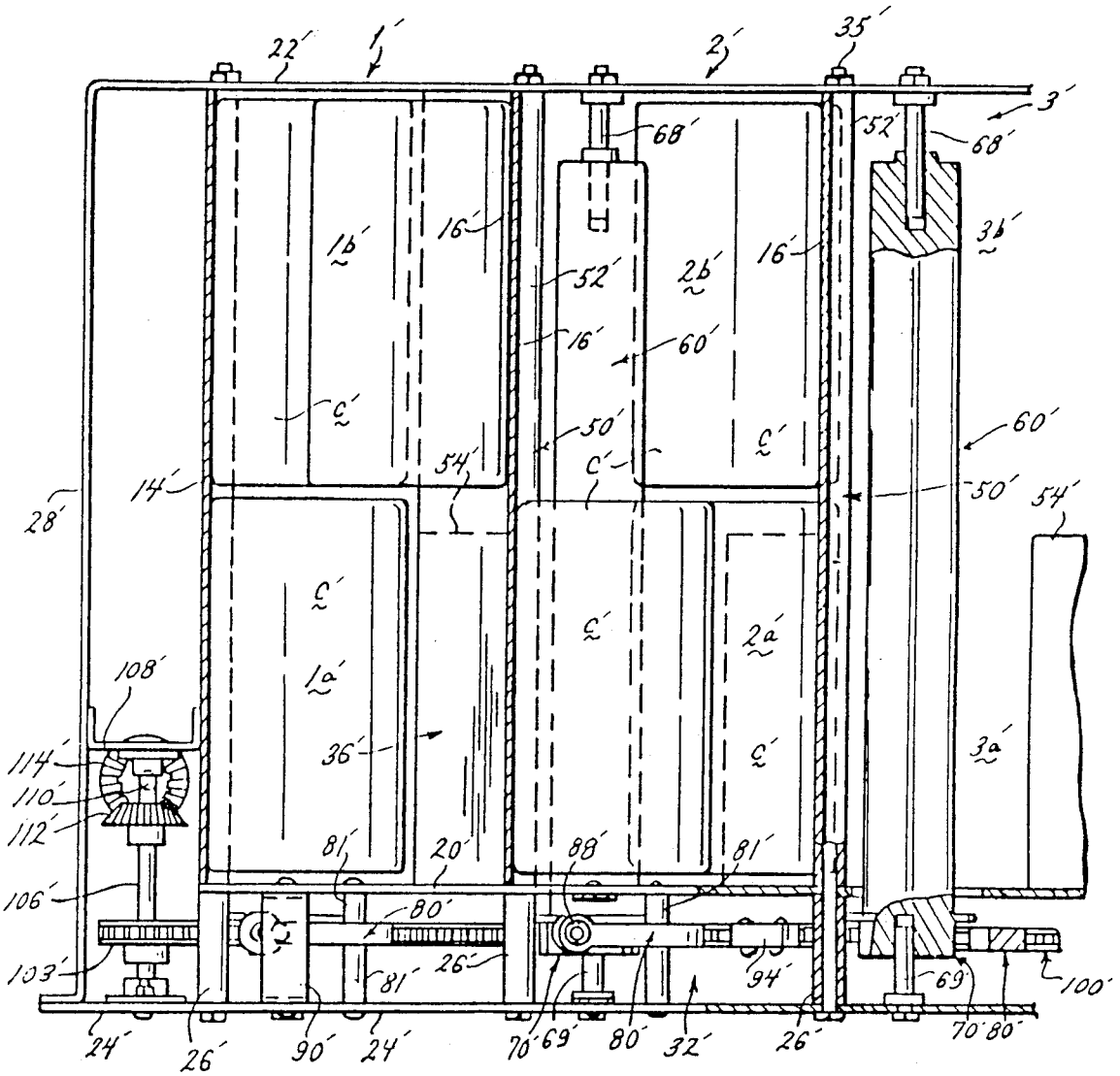
FIGS. 5–7 top plan views, partly in section, taken generally along line X—X in FIG. 1, showing several possible front to back product storage configurations of the vending machine of FIG. 1 and a portion of the product delivery mechanism that can be advantageously used with such configurations.
Figure 6:
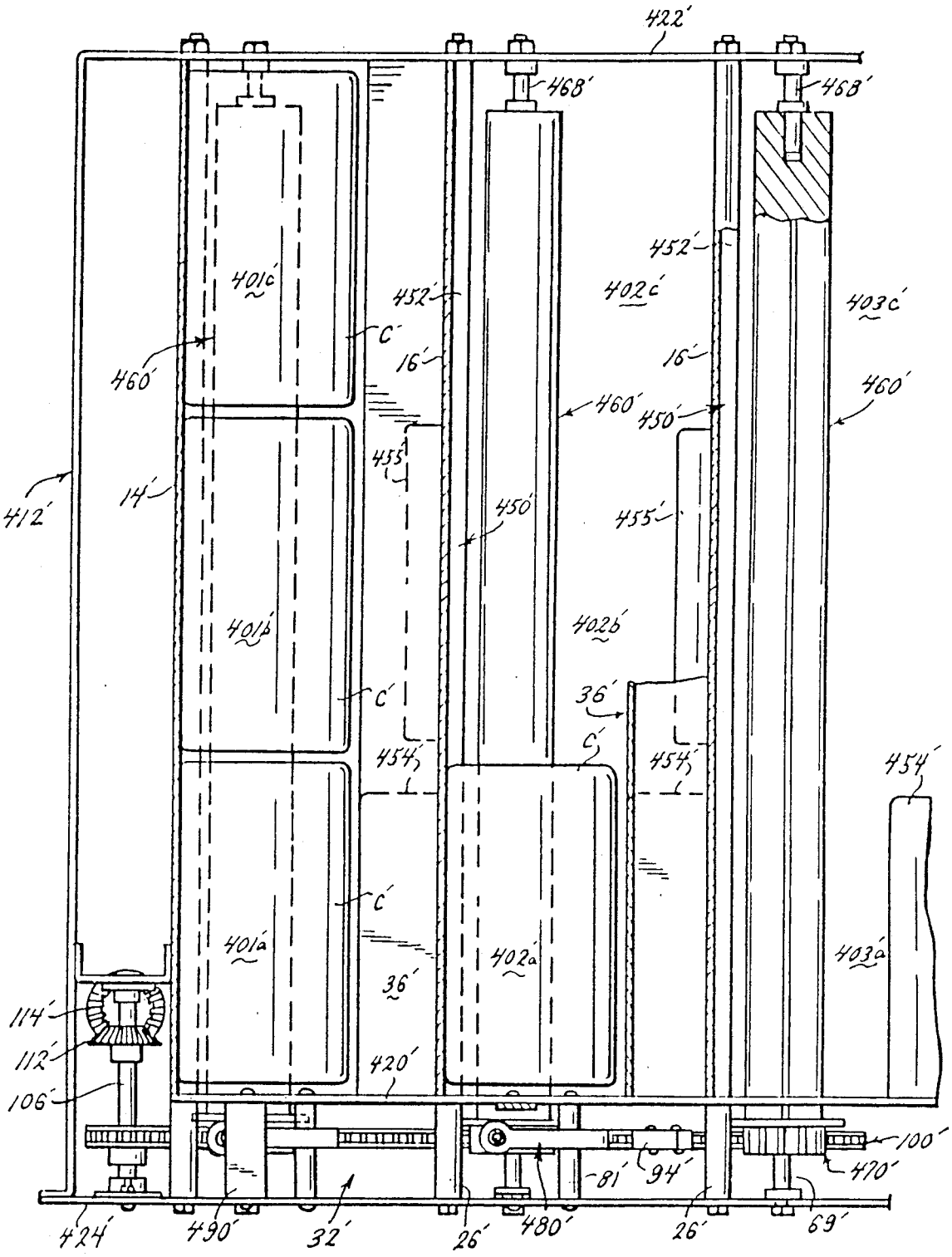
Figure 7:
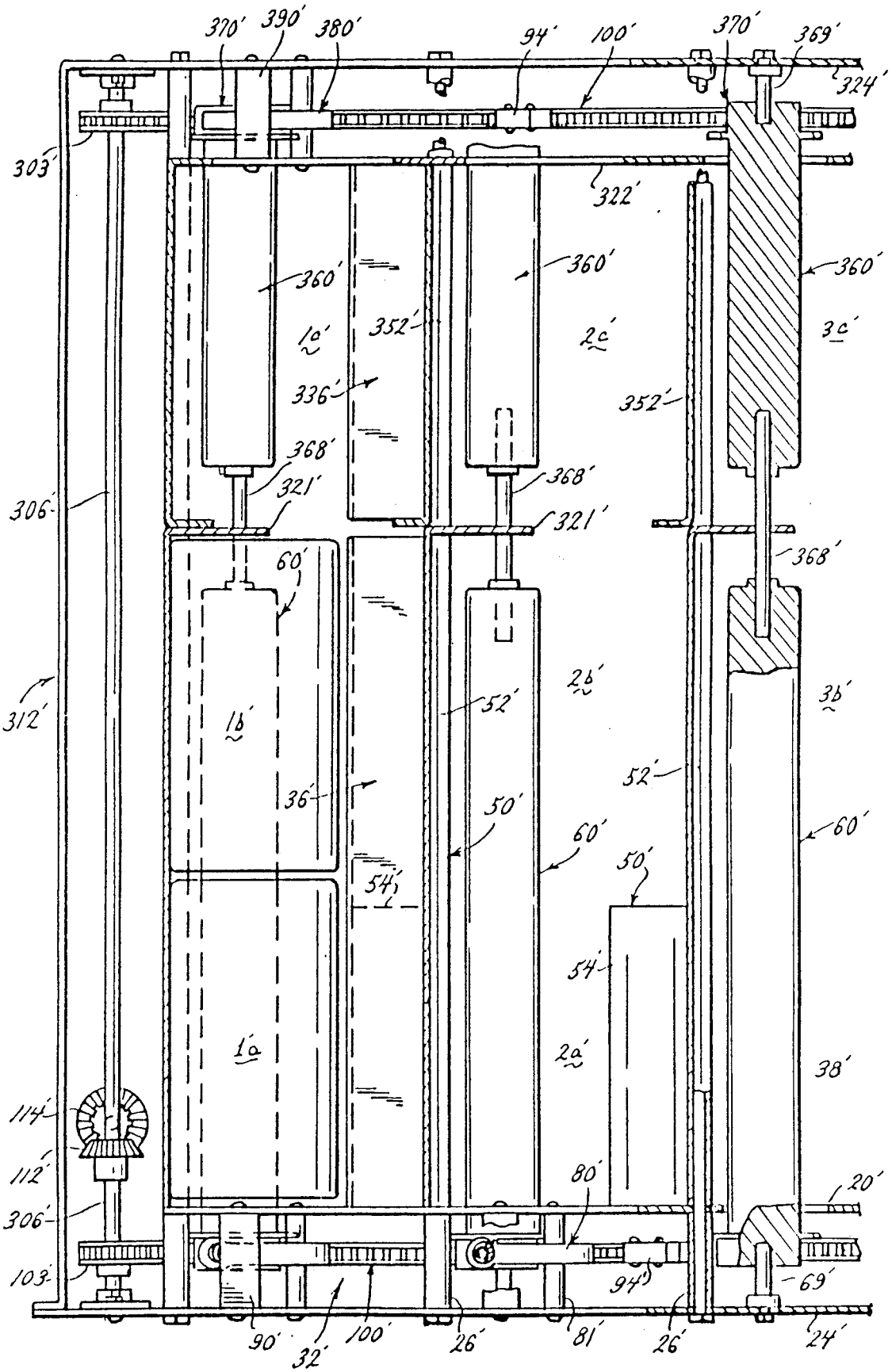

With particular reference now to FIG. 1, the number 10' identifies a vending machine the lower portion of which is so constructed, in the embodiment shown, to have along its width eight product storage columns 1'-8', each of which columns may be of sufficient depth to hold a plurality of products C' arranged in horizontal rows. As depicted in FIGS. 5 and 6, the depth of the columns may be varied to increase or decrease the number of products that may be stored in the horizontal rows, and, as depicted in FIG. 7, the columns may be partitioned from front to rear, such as by intermediate wall members 321', to create distinct product storage compartments in the vending machine. In the embodiment depicted in FIG. 7 the forward product storage compartment of each column is sized to hold two products arranged horizontally in an end-to-end configuration while the rear product storage compartment of each column is sized to hold only a single product. Thus, by way of illustration, column 1' is depicted as including portions 1'a, 1'b, and 1'c, with portions 1'a and 1'b defining a forward product storage compartment and portion 1'c defining a rear product storage compartment.

Figure 2:
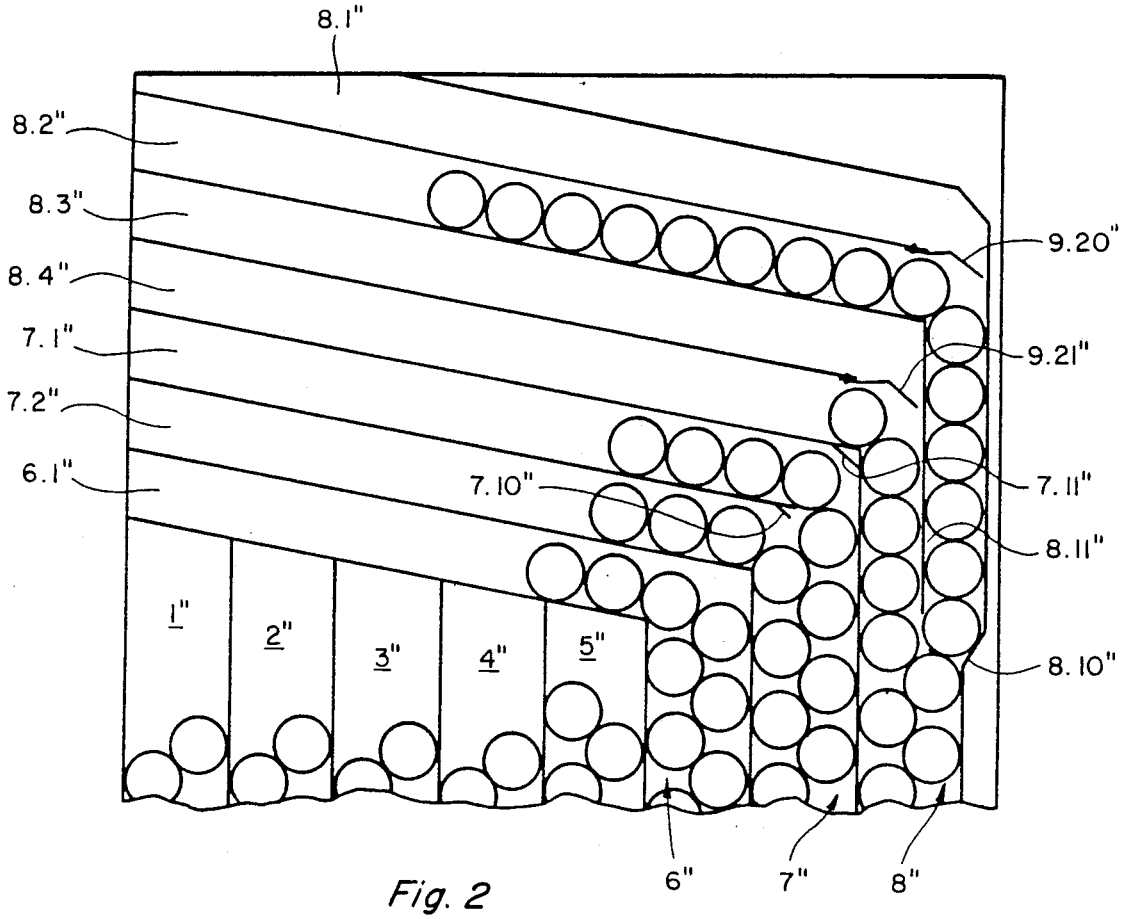
FIGS. 2–4 are schematic front views of several various upper portions of vending machines, which upper portions may be employed with the lower portion of FIG. 1.
Figure 3:
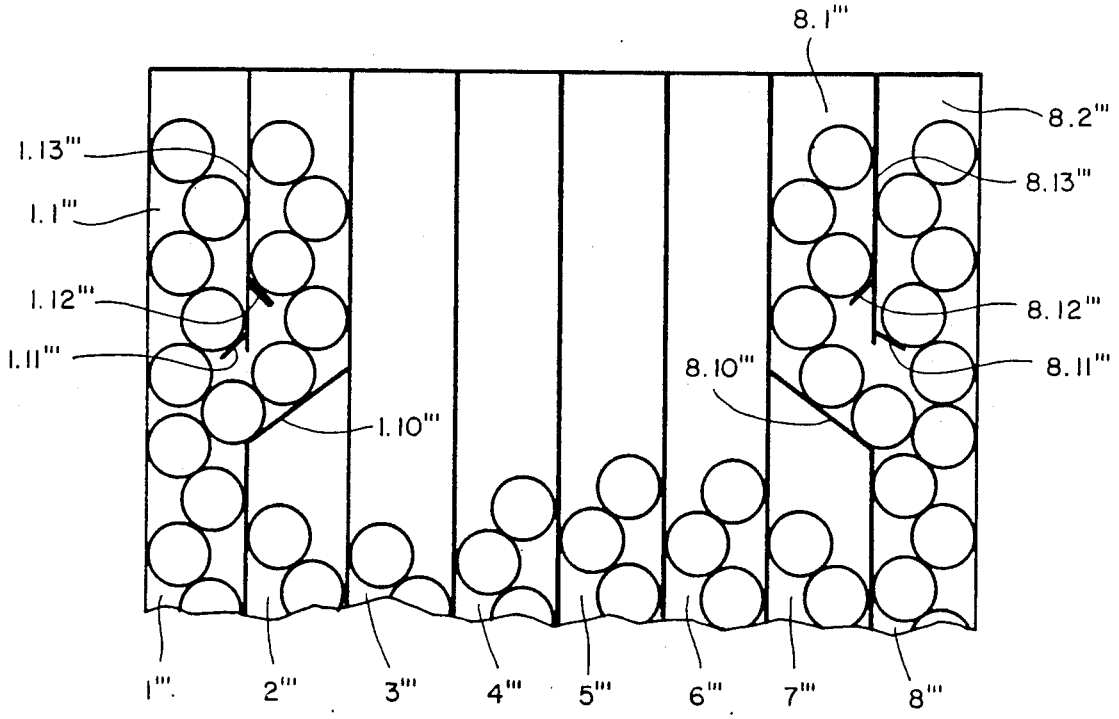
Figure 4:
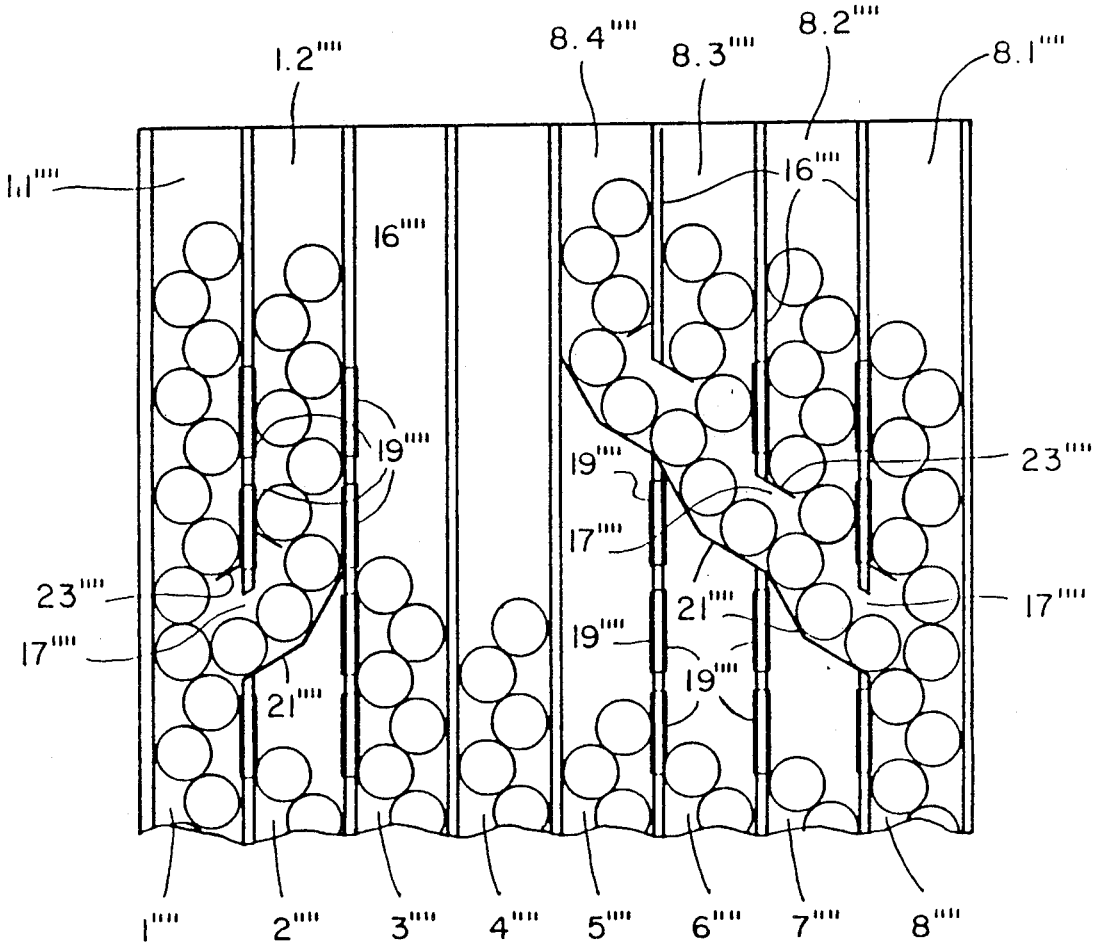

It will be appreciated that the vending machine 10' of FIG. 1 may be so constructed to have various upper portion embodiments that permit greater amounts of certain product types to be readily stored for vending. FIGS. 2-4 illustrate various possible embodiments of upper portions that could be so constructed to mate with the lower portion depicted in FIG. 1 and which exhibit various ways in which certain product types can be allocated greater storage space within the vending machine.

By way of example, the upper portion depicted in FIG. 2 includes upper column portions 1''-8'' that correspond to and are constructed to feed products to columns 1'-8' of FIG. 1. Upper column portions 6''-8'' have associated therewith angled storage compartments 6.1'', 7.1'', 7.2'', 8.1'', 8.2'', 8.3'', and 8.4'' that extend over the tops of upper column portions 1''-5'' and are so constructed that products stored in compartment 6.1'' feed into upper column portion 6'', products stored in compartments 7.1'' and 7.2'' feed into upper column portion 7'', and products stored in compartments 8.1''-8.4'' feed into upper column portion 8''. Guide means 7.10'' and 7.11'' help channel the flow of products from compartments 7.1'' and 7.2'' into upper column portion 7'' while guide means 8.10'' and 8.11'' and product gate means 8.20'' and 8.21'' help channel and control the flow of products from compartments 8.1''-8.4'' into upper column portion 8''.

FIG. 3 depicts another embodiment of an upper portion of a vending machine, which upper portion includes upper column portions 1'''-8''' that correspond to and are constructed to feed products to columns 1'-8' of FIG. 1. Upper column portions 3'''-6''' are depicted as full height columns, while upper column portions 2''' and 7''' are depicted as partial height columns and upper column portions 1''' and 8''' are depicted as columns with branched arms. Branch 1.1''' of upper column portion 1''' is shown extending directly above the lower portion of upper column portion 1''' and branch 1.2''' is shown disposed above upper column portion 2'''. Similarly, branch 8.1''' of upper column portion 8''' is shown extending directly above the lower portion of upper column portion 8''' and branch 8.2''' is shown disposed above upper column portion 7'''. Guide means 1.10'''-1.13''' help channel the flow of products from column arms 1.1''' and 1.2''' into the lower portion of upper column portion 1''' while guide means 8.10'''-8.13''' serve a similar purpose with respect to upper column portion 8'''.

FIG. 4 depicts a still further embodiment of an upper portion of a vending machine wherein the upper portion includes upper column portions 1''''-8'''' that correspond to and are constructed to feed products to columns 1'-8' of FIG. 1. At least certain of the sidewalls 16''' between the upper column portions include openings 17'''' therethrough, some of which openings are shown sealed by removable closure members 19''''. In addition, repositionable guide means 21'''' and 23'''' are shown installed in a manner that results in a product storage configuration wherein product storage areas 1.1'''' and 1.2'''' are established to feed products to upper column portion 1'''' and product storage areas 8.1''''-8.4'''' are established to feed products to upper column portion 8'''', and wherein the heights (and product storage capacity) of upper column portions 2''''-7'''' are thus effectively reduced. A better understanding of how the openings 17'''', the closure members 19'''', and the guide means 21'''' and 23'''' can be employed to establish any particular product storage configuration can be obtained by a review of U.S. Pat. No. 4,705,176, FIG. 4*a* of which corresponds closely to FIG. 4 herein.

It will be appreciated that with all of the embodiments of FIGS. 2-4 provision is made for increased product storage of certain types of products, i.e., products of greater demand, and for more limited product storage for other types of products, i.e., products of lesser demand. Those skilled in the art will recognize, however, that, regardless of the particular vending machine embodiment employed or the particular product storage configuration established, product delivery, at least from a vending machine whose lower portion is constructed similarly to that depicted in FIG. 1, can be readily effected by the product delivery system described in Applicant's co-pending U.S. Pat. application Ser. No. 230,963, now U.S. Pat. No. 4,991,739, as will be further apparent from the summary description of such delivery system provided hereinafter.

Products stored in embodiments of the type depicted in FIGS. 1 and 5-7 hereof may be conveniently delivered to the customer by the vend delivery systems shown in such figures, which delivery systems and the operation thereof are described in detail in Applicant's co-pending U.S. Pat. application Ser. No. 230,963, now U.S. Pat. No. 4,991,739. In brief, when a product selection for which sufficient credit has been entered is made, the vend control means for the vending machine, which vend control means often employs a programmed microprocessor, causes the motor M' (FIG. 1) to operate to move drive chain 100' in a clockwise direction to position an appropriate finger 94' or 95' adjacent the escapement member 80' (FIGS. 5 and 7), 380' (FIG. 7), or 480' (FIG. 6) associated with a product storage compartment in which are stored products of the type selected by the customer when he operated the product selection means. When the appropriate finger 94' or 95' is properly positioned, motor M' operates to cause drive chain 100' to move sufficiently in a counterclockwise direction to engage and pivot the proper escapement member 80', 380' or 480' so that the proper turnstile 60' (FIGS. 5 and 7), 360' (FIG. 7), or 460' (FIG. 6) can rotate under the weight of a product C' through a requisite degree of movement to deliver the desired product type. Those skilled in the art will recognize and understand that a programmed microprocessor with associated memory can be readily employed in the vend control means to keep track of the product storage configuration then in effect and to ensure that the motor M' will operate to advance the appropriate finger to engage the proper escapement member to effect the delivery of the desired type of product.

Figure 8:
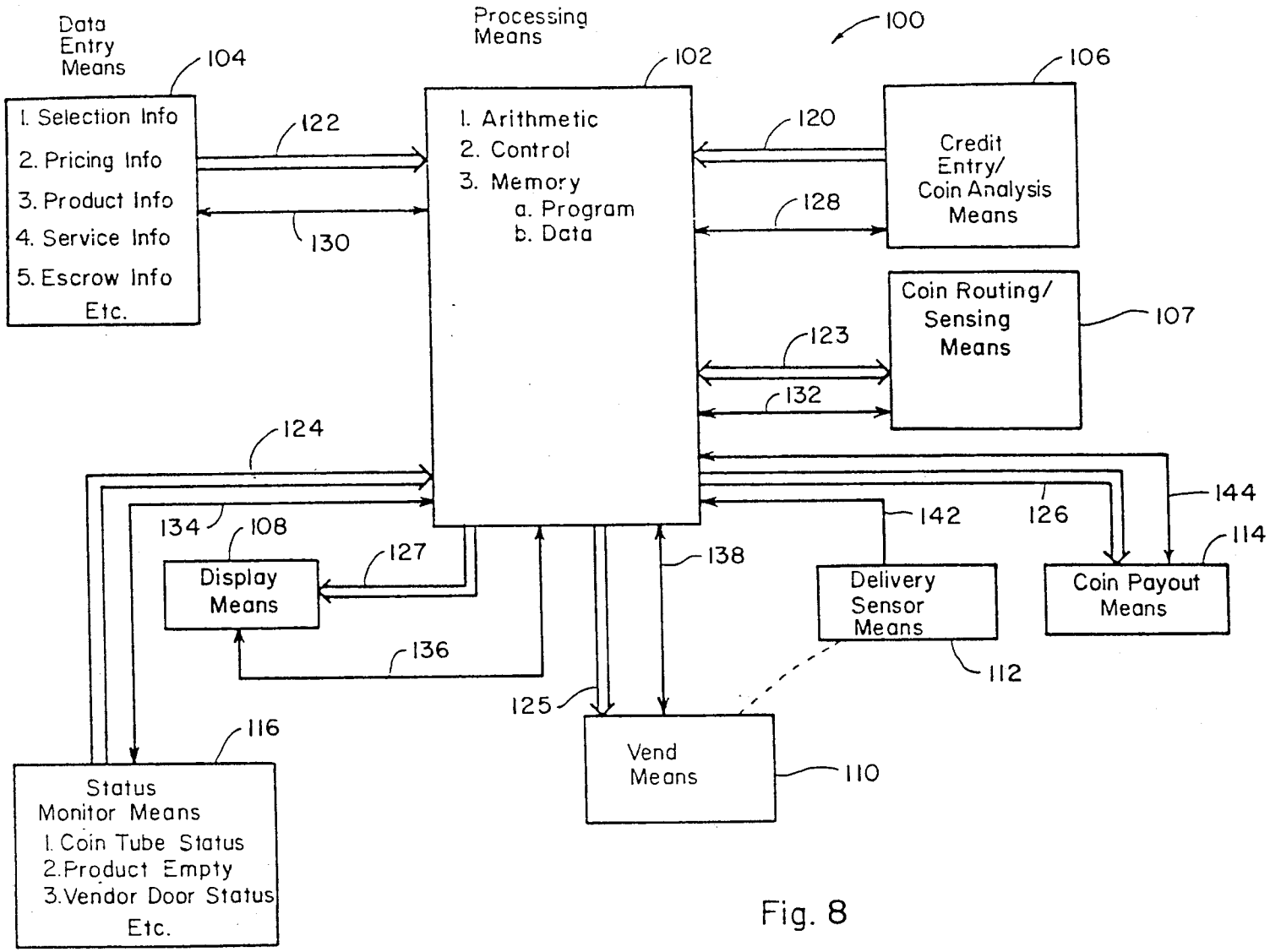
FIG. 8 is a block diagram of a typical vend control means for controlling the vending of products from the vending machine of FIG. 1.

FIG. 8 depicts in block diagram form a vend control means of the type that might typically be employed with the vending machine embodiments depicted in FIGS. 1-7 hereof. Number 100 identifies a microprocessor controlled vending system that includes a processing means 102, data entry means 104, credit entry/coin analysis means 106, coin routing/sensing means 107, display means 108, vend means 110, delivery sensor means 112, coin payout means 114, and status monitor means 116. The processing means 102 includes memory means as well as arithmetic and control means typical of a microprocessor controlled vending system. In the FIG. 8 embodiment coin analysis data may be supplied from the credit entry/coin analysis means 106 to the processing means 102 by means of a data path 120, data information of various types, including selection information, pricing information, product information, and service information, may be provided from the data entry means 104 to the processing means 102 by means of a data path 122, coin routing/sensing data may be provided from the coin routing/sensing means 107 to the processing means 102 by means of a data path 123, and status data, including coin tube status information, product empty information, and vendor status information, may be provided from the status monitor means 116 to the processing means 102 by means of a data path 124. Data for vend purposes may be provide from the processing means 102 to vend means 110 by way of data path 125, coin payout data may be provided from the processing means 102 to coin payout means 114 by way of data path 126, and information for display may be communicated from the processing means 102 to display means 108 by means of a data path 127. Various control and status signals may be intercommunicated among the components of the microprocessor controlled vending system by means of signal paths 128, 130, 132, 134, 136, 138, 142, and 144.

FIG. 9 illustrates a situation in which a particular product storage allocation configuration has been established for a vending machine constructed according to FIG. 1, wherein all of the columns 1'-8' are of depths to hold three products laid end-to-end in column portions a, b, and c thereof and all of the columns 1'-8' and their portions a, b, and c are of equal height such that equal numbers of products can be stacked in each of the portions a, b, and c of such columns, as a consequence of which the vending machine may be considered to have twenty-four storage areas of equal size, viz., the storage areas numbered 1-24 in FIG. 9, each of which storage areas is capable of holding approximately 4.17% of the total storage capacity of the vending system. It will be appreciated that a vend delivery system for such a vending machine embodiment can be readily constructed in accordance with the teachings of co-pending U.S. Pat. application Ser. No. 230,963, now U.S. Pat. No. 4,991,739, to permit individualized vending from each of the product storage areas 1-24. Alternatively, in accordance with the embodiment depicted in FIG. 7 and the vend delivery system therefor, storage areas 1 and 2, for example, of FIG. 9 could be considered to be a single storage compartment having two equal sized storage areas each of which areas has the same capacity as storage area 24. In any event, in the product storage allocation configuration depicted in FIG. 9 the twenty-four storage areas 1-24 are allocated among eight types of products A-H such that product A is assigned four storage areas 1-4, product B is assigned four storage areas 5-8, product C is assigned four storage areas 9-12, product D is assigned three storage areas 13, 14, and 18, product E is assigned three storage areas 15, 16, and 17, product F is assigned two storage areas 19 and 20, product G is assigned two storage areas 21 and 22, and product H is assigned two storage areas 23 and 24.

If the vending machine of FIG. 9 were fully loaded with eighteen cans per storage area according to the noted product storage allocation configuration, the product storage capacity and the percentage allocation per selectable type of product would be as specified in FIG. 10. Typically, if such a product storage allocation configuration were employed, the resulting product availability at the time of next servicing of the vending machine might be that noted in FIG. 10. It will be readily apparent that one cannot easily determine from such product availability status whether or to what extent the particular product storage allocation configuration in effect corresponds to product demand, especially since it cannot be determined from such product availability status whether products A and B were depleted at an early time before servicing or just before servicing. In actuality, the sales history for the products might well have been that set forth in FIG. 11, which history reveals that product A sold out during the fourth day of a seven day service cycle and product B sold out during the fifth day of the service cycle. While such sales history might lead one studying it to conclude that adjustments in the product storage allocation configuration would be desirable, an individual servicing the vending machine generally does not have any way of determining such history and is limited to an evaluation of the product availability status at the time of servicing in making any determination regarding the acceptability of the product storage allocation configuration in effect.

FIGS. 12–14, 15–17, 18–20, 21–23, and 24–26 are figure groupings each of which includes a figure similar to FIG. 9 depicting a particular product storage allocation configuration, a figure similar to FIG. 10 identifying the product storage capacities and percentage allocations per selectable type of Product for such particular product storage allocation configuration and a typical product availability status at the time of servicing, and a figure similar to FIG. 11 including a typical sales history during a service cycle of the vending machine. In each instance, service personnel would have difficulty in determining from the product availability status at the time of servicing whether or to what extent the particular product storage allocation configuration in effect corresponds to product demand.

Applicant's co-pending U.S. Pat. application Ser. No. 303,547, filed Jan. 27, 1989, discusses and describes a vend space allocation monitor means and method that can be employed by service personnel to readily ascertain whether or not the product storage allocation configuration in effect for any given vending machine is acceptable, based upon the historical demand for the various products vended by such vending machine. As is explained in such application, from FIGS. 11, 14, 17, 20, 23, and 26, which figures include typical sales history data for the product storage allocation configurations depicted in FIGS. 9, 12, 15, 18, 21, and 24, respectively, it can be observed that, if records of product demand are maintained up until the time of the first product sell-out, it is possible to calculate demand percentages by product type, which demand percentages can then be utilized to determine the extent to which such demand percentages deviate from the then-current product storage allocation percentages of the various product types and whether such deviations are within acceptable norms.

Through use of the vend space allocation monitor means and method of Applicant's co-pending U.S. Pat. application Ser. No. 303,547, filed Jan. 27, 1989, service personnel can thus determine whether an established vend space allocation configuration for a given vend system is consistent with the historical demand for the various vend products. With more sophisticated forms of such invention, sufficient data, such as the deviation information of the type appearing in the lower portions of FIGS. 11, 14, 17, 20, 23, and 26, might even be available to such service personnel to allow them, on the basis of such data, to effect a reallocation of vend space. As is explained in Applicant's co-pending U.S. Pat. application Ser. No. 303,547, filed Jan. 27, 1989, however, such service personnel must still exercise some judgment in the interpretation of the data in order to determine an appropriate reallocation configuration, as a consequence of which a degree of subjectivity is built into any determination. The present invention is intended and designed to be an improvement over the vend space allocation monitor means and method of Applicant's co-pending U.S. Pat. application Ser. No. 303,547, filed Jan. 27, 1989, in that it provides a means and method for objectively determining, based upon historical demand for the various vend product selections, a desirable vend space allocation configuration for a given vend system.

It should be recognized that, if the total storage of a given vend system is known, and if the capacities of individual storage areas of the vend system are known, it is possible, especially in the case of a vend system that employs a plurality of storage areas of equal capacity, to calculate or otherwise objectively determine the number and/or identities of individual storage areas that should desirably be allocated for storage of different types of products from the calculated demand percentages for such different types of products. By way of example, for the vend space allocation configuration of FIG. 9 and the sales history data of FIG. 11, which sales history data is also set forth in FIG. 27 along with other pertinent vend space allocation configuration information, a desired storage area distribution count for each different product type can be calculated according to the formula $$S_n = [\%_{dist(n)} \times P_{tc}]/C,$$

where n is a variable representing a product A–H, $S_n$ refers to the desired storage area distribution count for product n, $P_{tc}$ refers to total product capacity of the vend system, C refers to the capacity of the individual, like-sized storage areas, and $\%_{dist(n)}$ refers to the percentage distribution of product n by demand at first product sell-out, i.e., $$\%_{dist(n)} = P_{demand(n)}/P_{demand(t)},$$

where $P_{demand(n)}$ refers to the demand for product n to first product sell-out and $P_{demand(t)}$ refers to total product demand for all products to first product sell-out.

FIGS. 27–32 illustrate how such storage area distribution counts can be determined based upon product sales histories of FIGS. 11, 14, 17, 20, 23, and 26 as repeated in FIGS. 27–32, respectively. BY way of example, FIG. 27 includes in its upper portion thereof information corresponding to that set forth in FIGS. 9–11, including the product sales history as set forth in FIG. 11 and the monitored demand for product n to first product sell-out, i.e., $P_{demand(n)}$, and the monitored total product demand for all products to first product sell-out, i.e., $P_{demand(t)}$. FIG. 27 further includes in its lower portion calculations and determinations based such monitored demand values, the total product capacity of the vend system, and the capacity of the individual, like-sized storage areas such that desired storage area distribution counts, i.e., $S_n$, can be calculated for each of products A–H. Based upon such information, product A should preferably have 8.60 storage compartments allocated for product storage, product B should have 5.97, product C should have 2.39, product D should have 1.55, product E should have 2.15, product F should have 1.67, product G should have; 0.96, and product H should have, 0.72 storage compartments.

In most cases, if such storage area distribution counts are rounded off, the resulting combination of numbers will identify a desired optimal count distribution of storage areas for the products based upon the monitored and recorded historical demand for such products. However, as can be seen from FIG. 27, in some cases such rounding off may result in the specification of a total number of storage areas greater than the number of storage areas actually available in the vend system. In such event, it is necessary to employ some adjustment technique to reduce the total number of storage areas specified to the number of storage areas actually available. One possible technique is to adjust the standard rounding off break-point of .50 upwardly until the rounding off operation results in the specification of a total number of storage areas that is equal to the number of storage areas actually available in the vend system. If such technique is employed with FIG. 27, the resulting adjusted $S_n$ values are obtained, which values specify an optimal storage area distribution count based upon the monitored historical demand values for the products, the total product capacity of the vend system, and the capacity of the individual, like-sized storage areas. In similar fashion, FIG. 28 finds correspondence with FIGS. 12–14, FIG. 29 finds correspondence with FIGS. 15–17, FIG. 30 find correspondence with FIGS. 18–20, FIG. 31 finds correspondence with FIGS. 21–23, and FIG. 32 finds correspondence with FIGS. 24–26.

It will be appreciated that the rounded off and/or adjusted $S_n$ values can be communicated to service personnel in a variety of ways, such as by way of an alphanumeric display, such that the service personnel can reconfigure the vend system in accordance with such values. Still further, with a microprocessor controlled vending system, the microprocessor can be programmed to communicate to service personnel an actual configuration scheme based upon the $S_n$ values, e.g., by displaying for each product type the specific storage areas within the vend system that are to be allocated to such product type or by displaying in a light panel configuration, perhaps in response to data entry by service personnel, specific storage areas to be allocated for the various products to be vended.

Figures 33, 34, 35, 36, 37, 38, 39, 40, 41:
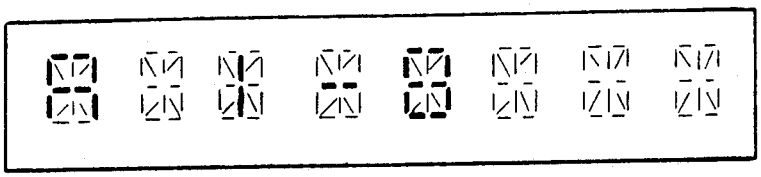
FIG. 33 depicts an alphanumeric display means displaying a preferred allocation of product storage areas for product A.
FIGS. 34–41 depict a light panel display displaying, respectively, preferred product storage allocations for products A–H, in accordance with the desired storage area distribution counts of FIG. 32.

By way of example, FIG. 33 depicts an alphanumeric display means whereon is depicted "A 1–8" signifying that storage areas 1–8 in the vend system of FIG. 9 should be allocated to product A. For the $S_n$ values of FIG. 32 one might anticipate the display of reconfiguration information, as follows:

| | |
|---|---|
| A | 1–8 |
| B | 9–14 |
| C | 15–17 |
| D | 18–19 |
| E | 20–21 |
| F | 22 |
| G | 23 |
| H | 24 |

Such information may be displayed in a cyclically repeating form or as a response to a data entry by the service personnel or in response to other stimuli.

If a light panel is utilized, the display of like information can be effected as depicted in FIGS. 34–41, wherein the illuminated lights depict the storage area reconfiguration groupings for the various products. As with an alphanumeric display, the individual groupings information may be displayed in a cyclically repeating form or as a response to a data entry by the service personnel, e.g., actuation of a specific product selection means, or in response to other stimuli.

It will be appreciated that the particular design of any given vend system plays a role in the product storage allocation configurations that can be realized. Information regarding the particular vend system design can be employed in conjunction with rounded off or adjusted $S_n$ values to identify and communicate to service personnel particular reconfiguration schemes that would be advantageous for such system design, based upon the historical demand for the various products. This is especially true of microprocessor based vending systems in which the processing means can be programmed to use the calculated desired storage area distribution counts and vend system design information to develop a preferred reconfiguration scheme. By way of example, for a vending system constructed according to FIG. 8, wherein the vending machine is constructed according to FIG. 1, with all of the columns 1'–8' being of depths to hold three products laid end-to-end in column portions a, b, and c thereof, as in FIG. 7, and all of the columns 1'–8' and their portions a, b, and c being of equal height such that equal numbers of products can be stacked in each of the portions a, b, and c of such columns, as a consequence of which the vending machine may be considered to have twenty-four storage areas of equal size, each of which storage areas is capable of holding approximately 4.17% of the total storage capacity of the vending system, with the vend delivery system constructed in accordance with FIG. 7 and the teachings of co-pending U.S. Pat. application Ser. No. 230,963, now U.S. Pat. No. 4,991,739, to permit vending from the product storage areas, a preferred reconfiguration scheme as specified and depicted in FIG. 42 can be readily developed by the processing means 102 from system design data and the adjusted $S_n$ values of FIG. 27. In similar fashion, a preferred reconfiguration scheme as specified and depicted in FIG. 43 could be readily developed from the rounded off $S_n$ values of FIGS. 28 and 29 and a preferred reconfiguration scheme as specified and depicted in FIG. 44 could be readily developed from the rounded $S_n$ values of FIGS. 30–32.

Figure 45:
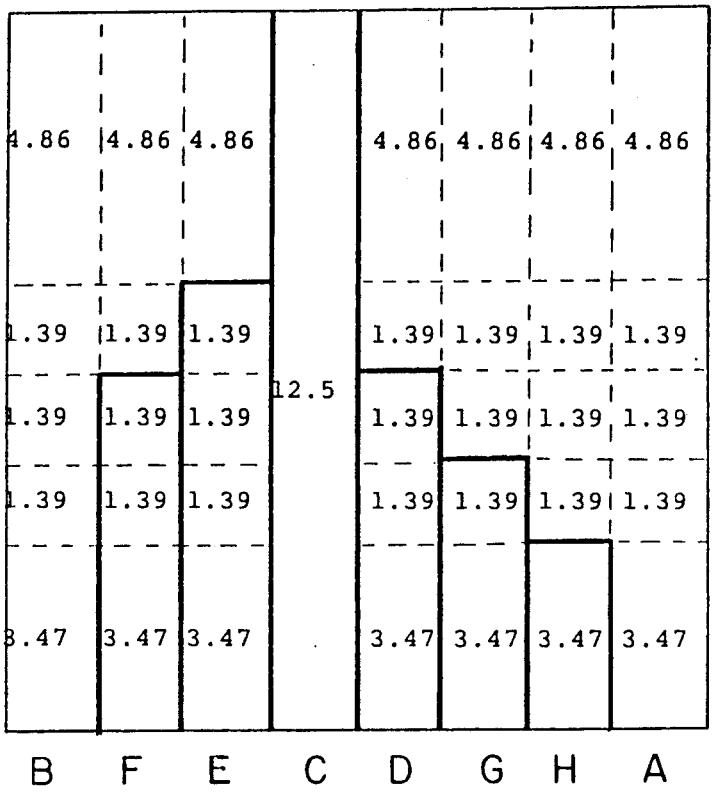
FIGS. 45–46 represent various preferred vend space allocation configurations of a vending machine constructed in accordance with FIGS. 1 and 4, which vend space allocation configurations were determined from FIGS. 27-32, respectively.
Figure 46:
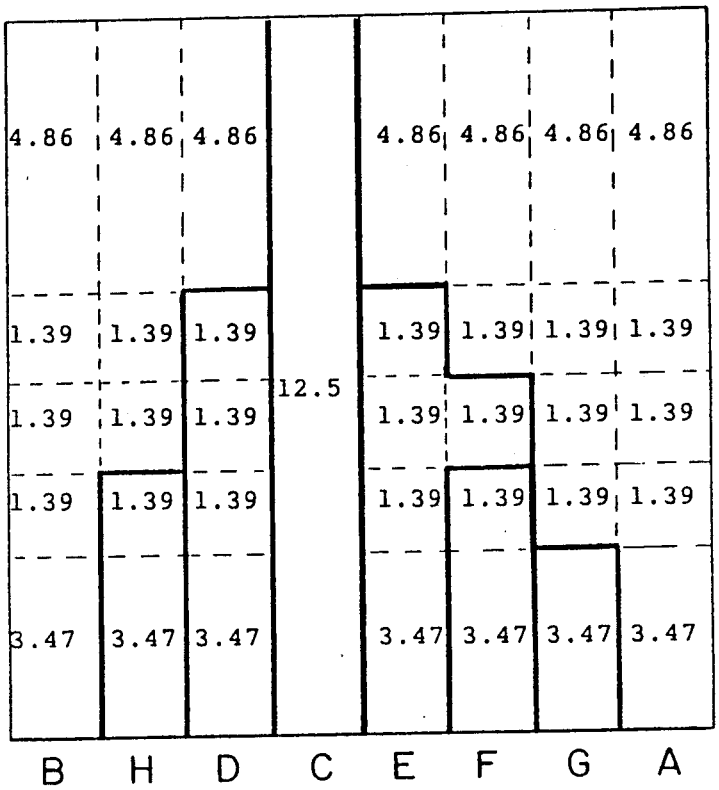

While the foregoing clearly demonstrates how, for a vending system that has a plurality of like-sized storage areas, the present invention operates and can be utilized to determine a preferred vend space allocation configuration based upon the historical demand for the various vend product selections, it must be recognized that such invention is not limited to use with systems that employ only like-sized storage areas, but can also be advantageously utilized with systems that have storage areas of various sizes. One type of such a system would be a system constructed according to FIG. 8, wherein the vending machine is constructed according to FIGS. 1 and 4 to permit the establishment of various configuration schemes through the use of openings 17'''' in the sidewalls 16'''', closure members 19, and repositionable guide means 21'''' and 23'''', and wherein a suitable vend delivery system, such as a vend delivery system constructed in accordance with the teachings of co-pending U.S. Pat. application Ser. No. 230,963, now U.S. Pat. No. 4,991,739, is provided. With such a system, the percentage distribution of the various products by demand, i.e., $\%_{dist(n)}$, could be readily employed in reconjunction with system design data to determine, particularly from look-up tables and/or through programmed matching techniques, preferred reconfiguration schemes based upon the historical demand for the various products available. Thus, FIG. 45 specifies and depicts a preferred vend space allocation configuration for such a system based upon the historical product demand and the resulting percentage distributions of the various products by demand, i.e., $\%_{dist(n)}$, set forth in FIG. 27. By a similar token, and as an example of how such a system can be reconfigured to match product demand, FIG. 46 specifies and depicts a preferred vend space allocation configuration for such a system based upon the historical product demand and the resulting percentage distributions of the various products by demand, i.e., $\%_{dist(n)}$, set forth in FIG. 32.

Figure 47:
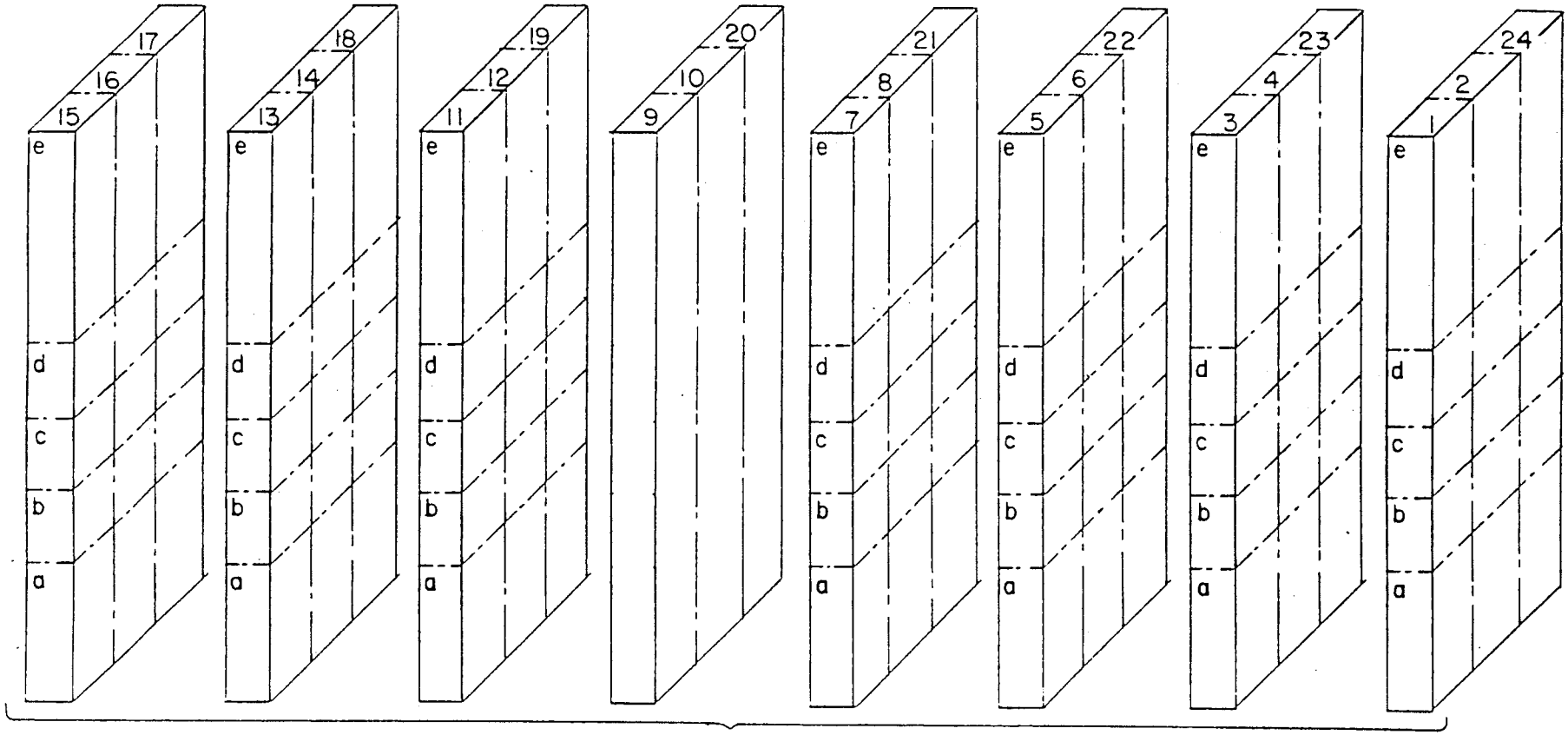
FIG. 47 represents the product vend space of a vending machine constructed in accordance with FIGS. 1, 4, and 7, shown in a partially exploded view.
Figure 48:
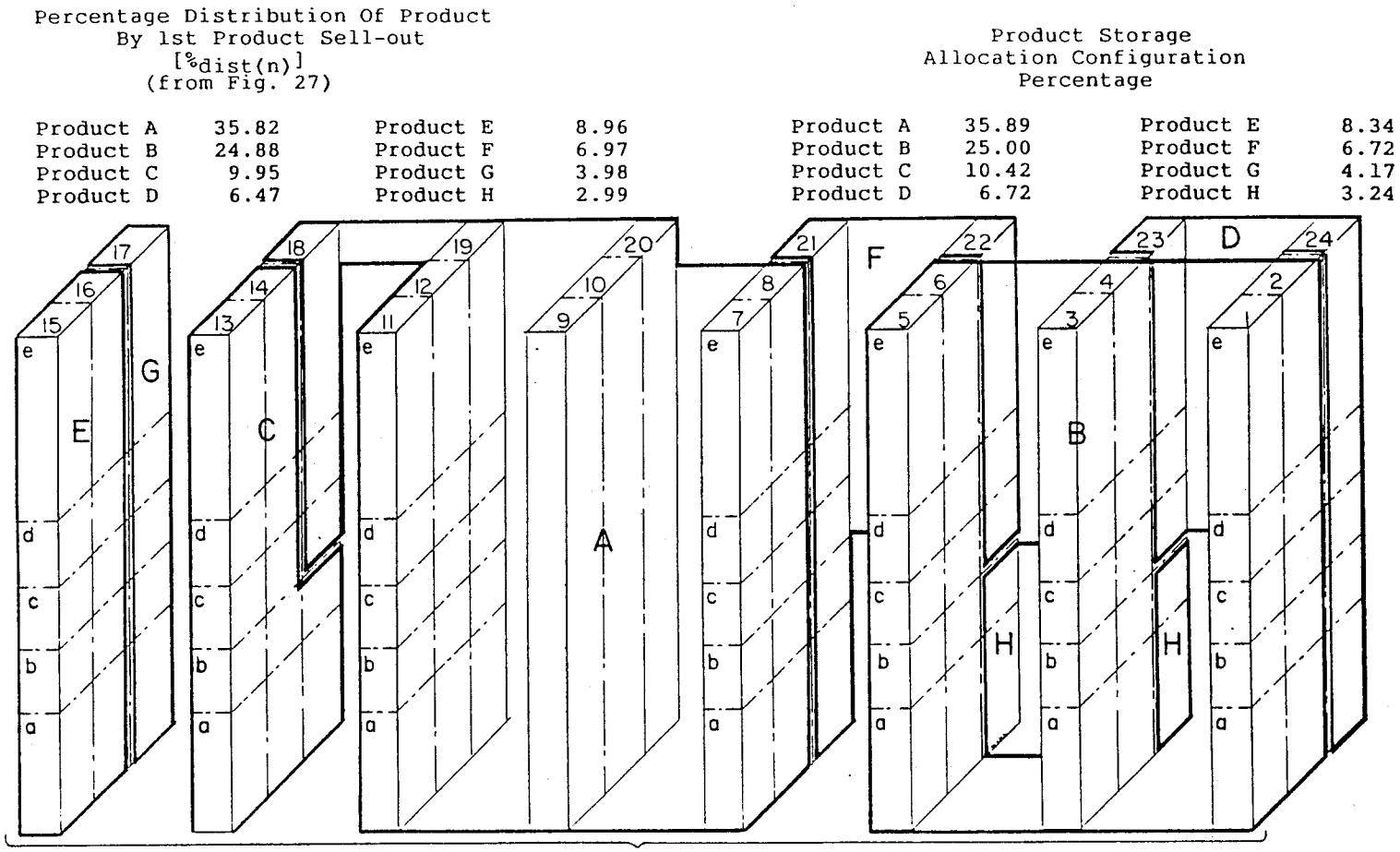
FIG. 48 represents a preferred vend space allocation configuration of the vending machine of FIG. 47, which vend space allocation configuration was determined from FIG. 27, shown in a partially exploded view.
Figure 49:
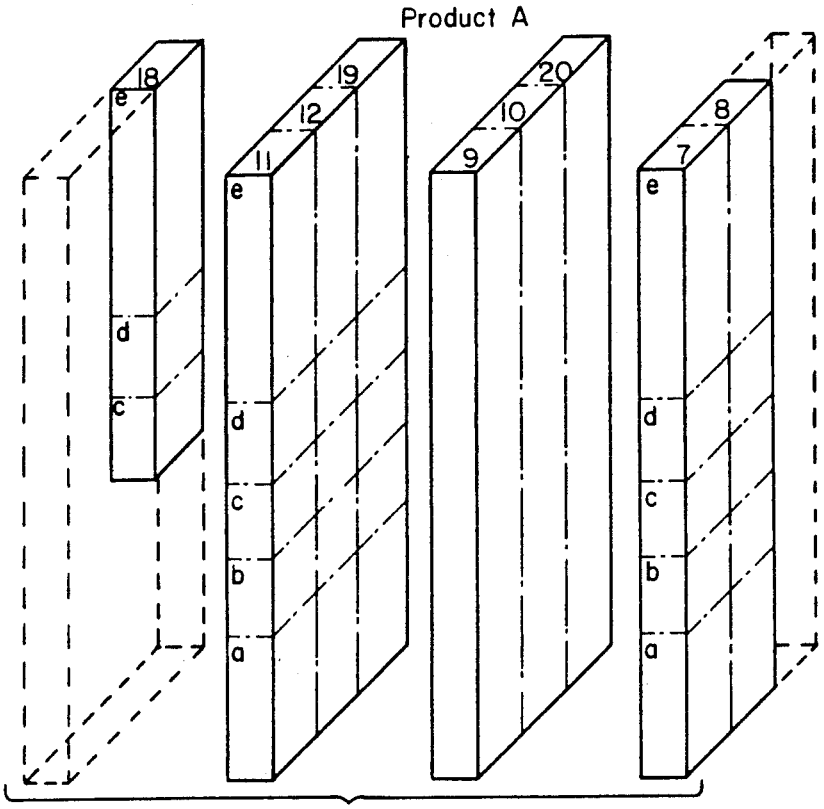
FIGS. 49-56 represent the preferred vend space allocations for the various products as depicted in FIG. 48, some of which are shown in partially exploded views.
Figure 50:
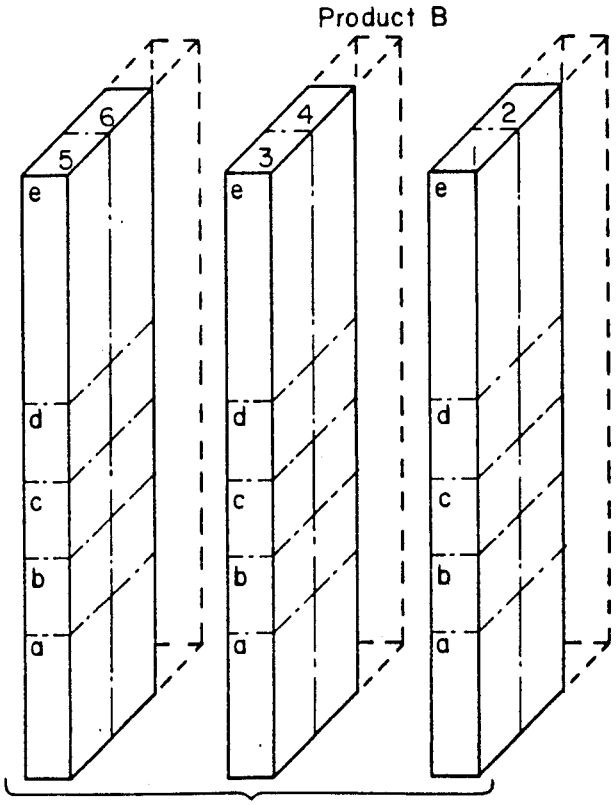
Figure 51:
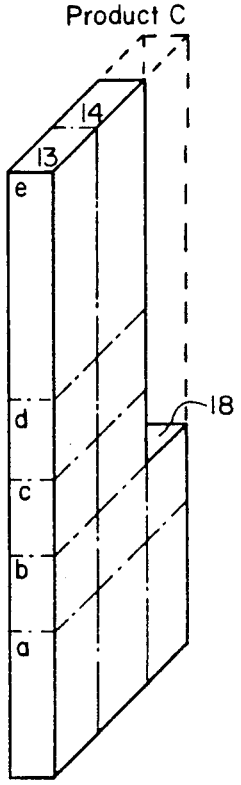
Figure 52:
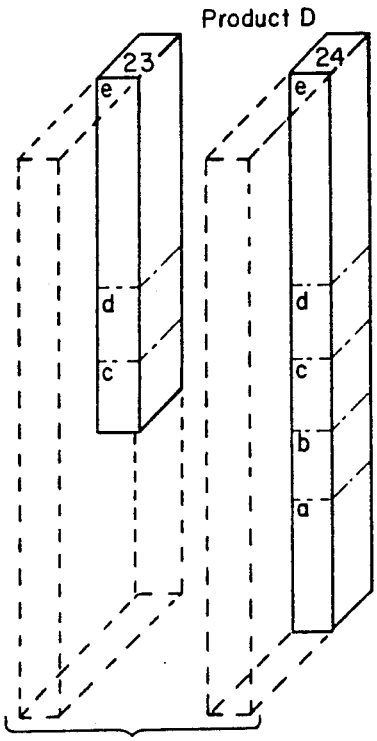
Figure 53:
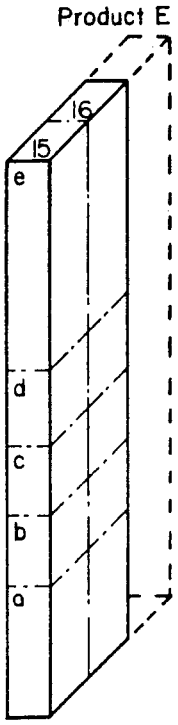
Figure 54:
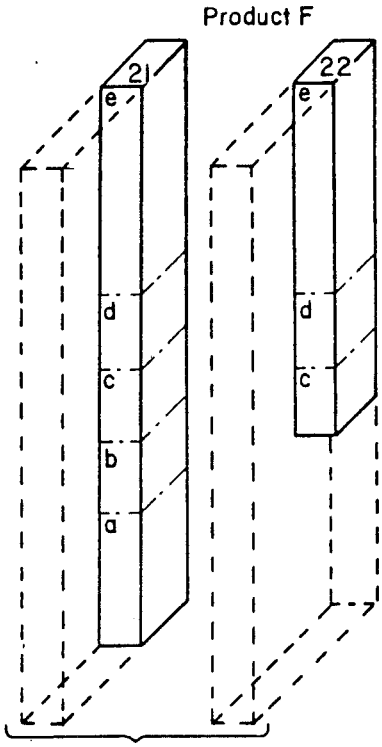
Figure 55:
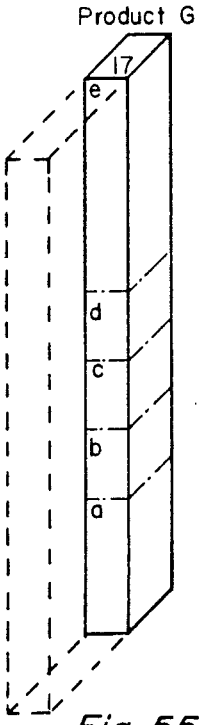
Figure 56:
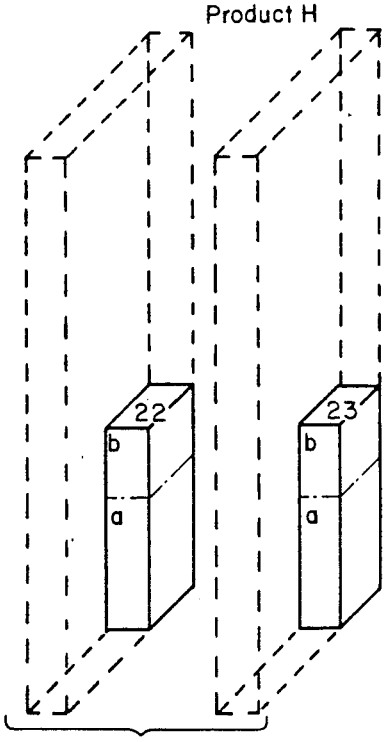
Figure 57:
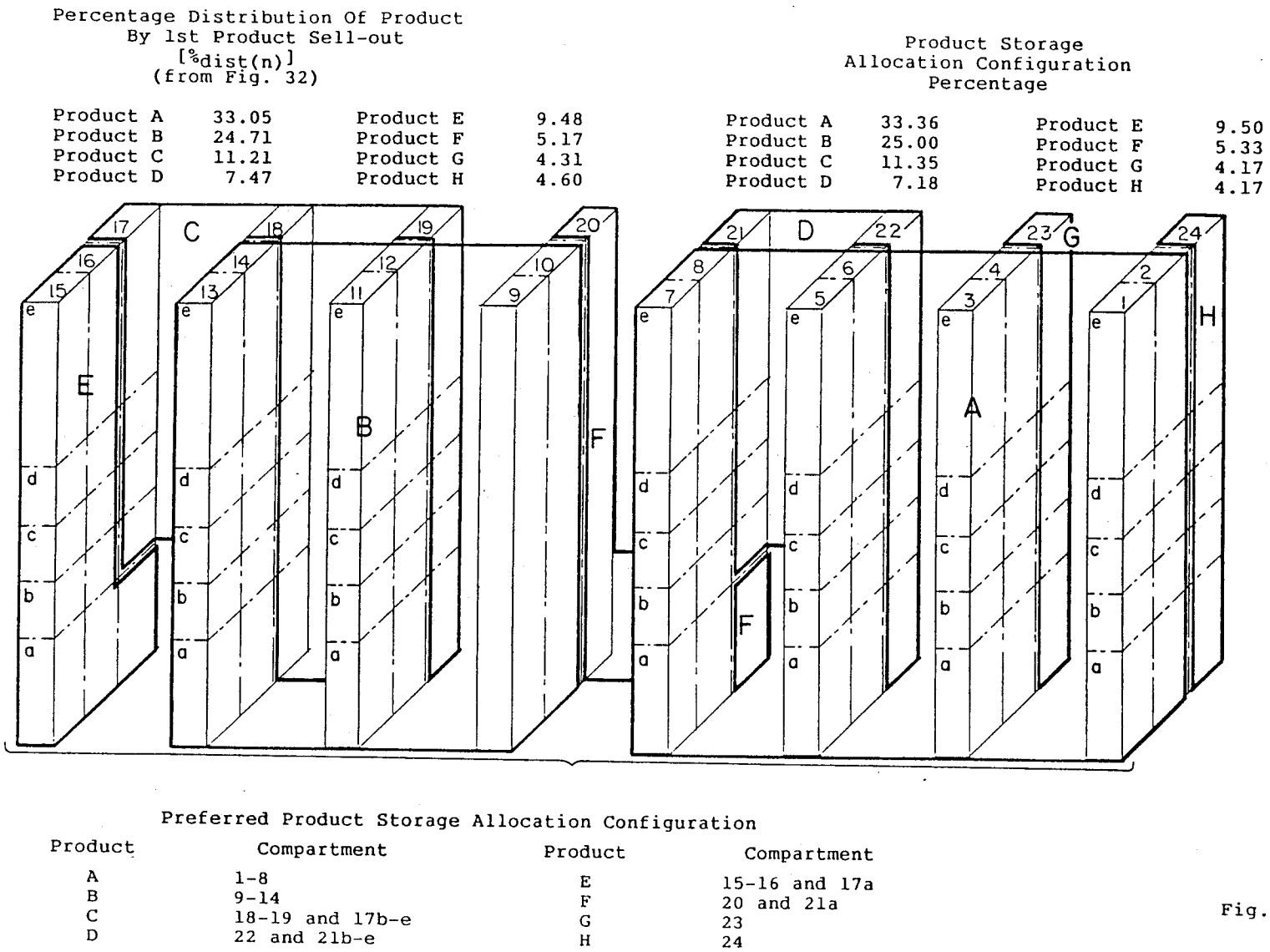
FIG. 57 represents a preferred vend space allocation configuration of the vending machine of FIG. 32, which vend space allocation configuration was determined from FIG. 27, shown in a partially exploded view.
Figure 58:
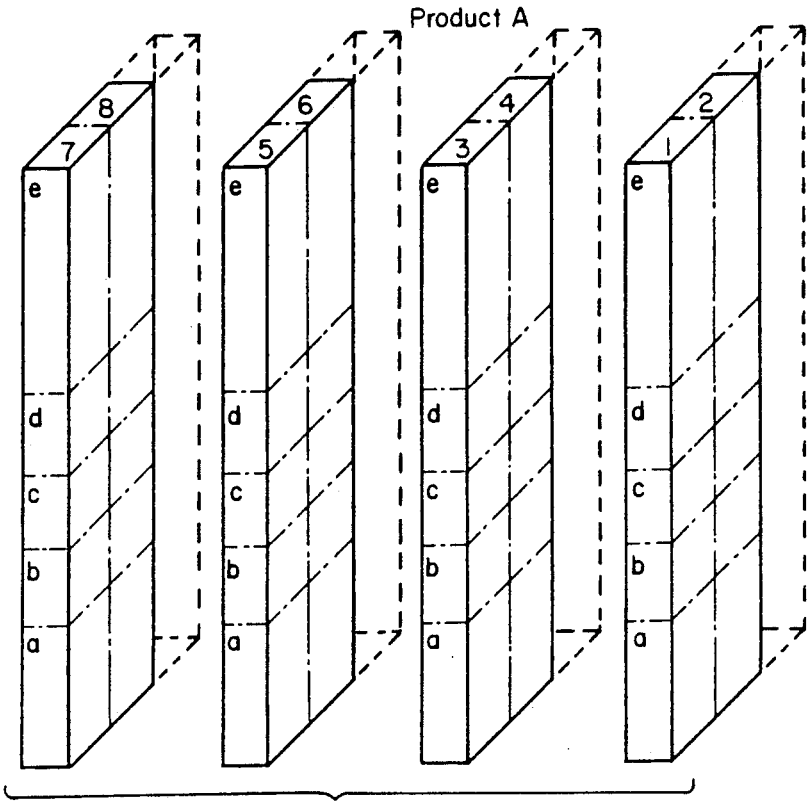
FIGS. 58-65 represent the preferred vend space allocations for the various products as depicted in FIG. 57, some of which are shown in partially exploded views.
Figure 59:
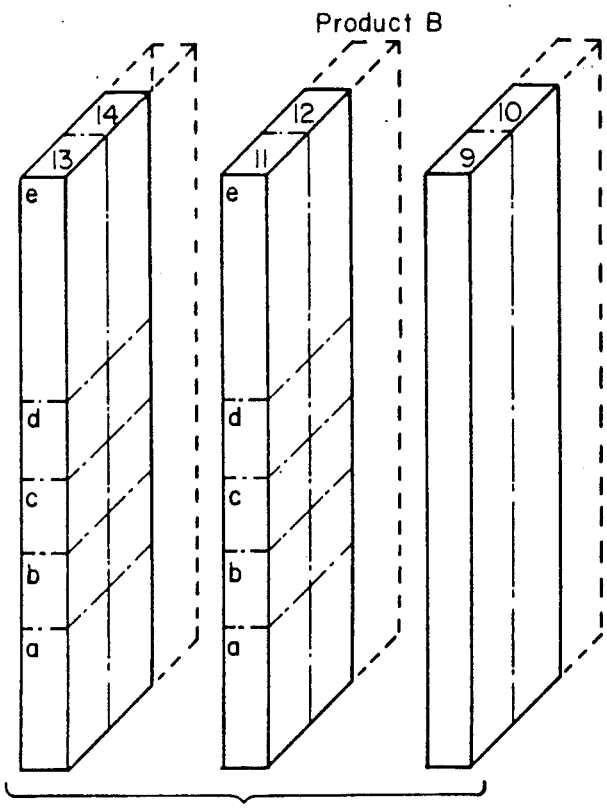
Figure 61:
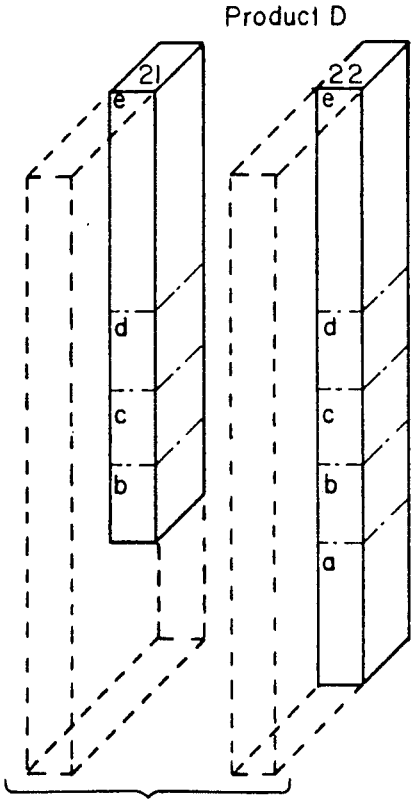
Figure 60:
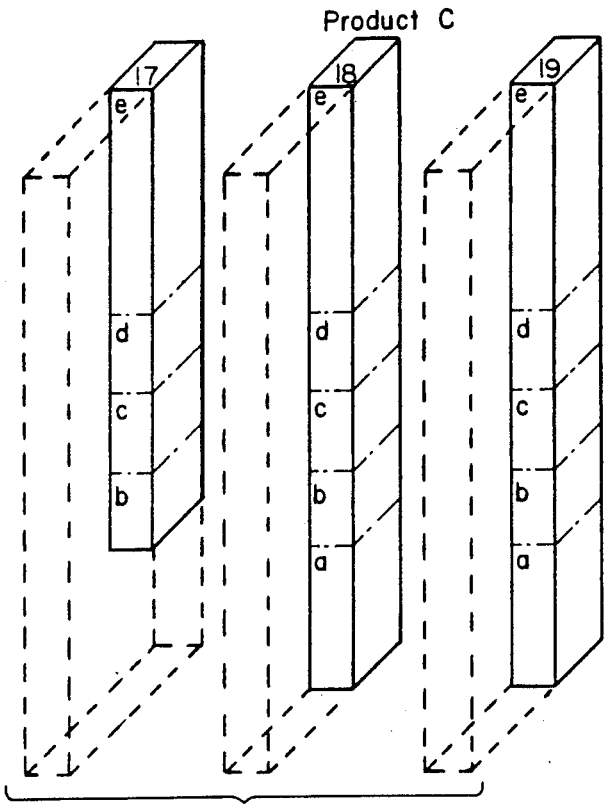
Figure 62:
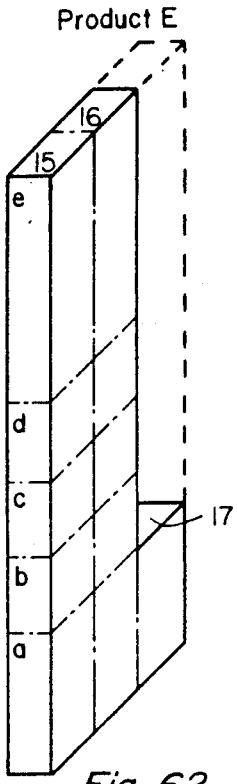
Figure 63:
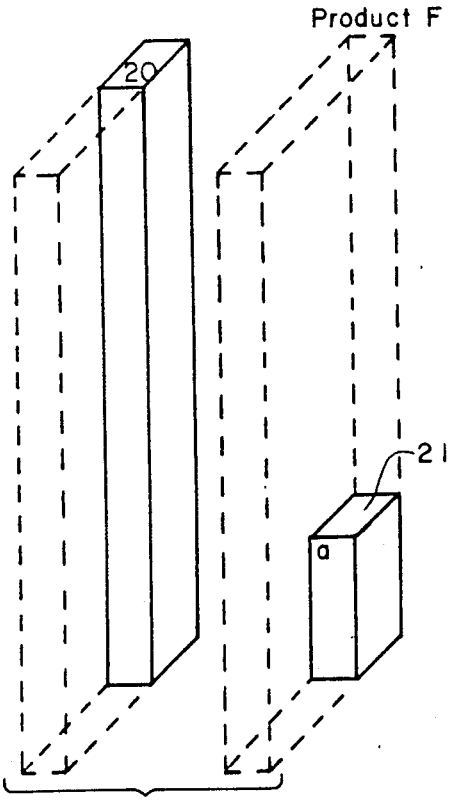
Figure 64:
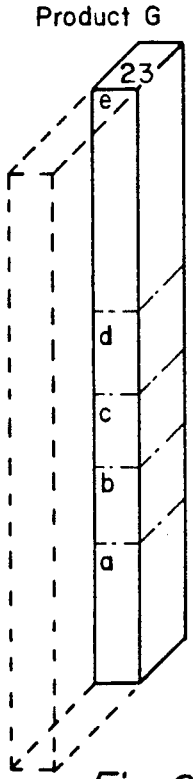
Figure 65:
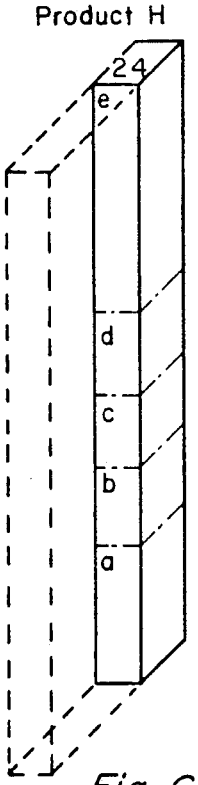

From what has already been discussed, it should be further apparent that the present invention can find application with vending systems that employ still more complex vending machine structures, such as a vending system constructed according to FIG. 8 with a vending machine structure that combines the features of FIGS. 1, 4, and 7, such that the product storage areas of such vending machine can be represented in the fashion depicted in FIG. 47. With such a vending system, the percentage distribution of the various products by demand, i.e., $\%_{dist(n)}$, could be readily employed in conjunction with system design data, as discussed previously, to determine, particularly from look-up tables and/or through programmed matching techniques, preferred reconfiguration schemes for the particular vending machine under discussion, based upon the historical demand for the various products available or provided in such vending machine. To that end, FIG. 48 specifies and depicts a preferred vend product storage allocation configuration for such a system and vending machine based upon the historical product demand and the resulting percentage distributions of the various products by demand, i.e., $\%_{dist(n)}$, set forth in FIG. 27. For purposes of clarity, FIGS. 49–56 depict the preferred allocations by vend space areas for the products A-H that are available in such vending machine, as specified and depicted in FIG. 48. In similar fashion, FIG. 57 specifies and depicts a preferred vend space allocation configuration for such a system and vending machine based upon the historical product demand and the resulting percentage distributions of the various products by demand, i.e., $\%_{dist(n)}$, set forth in FIG. 33, with FIGS. 58–65 depicting, for purposes of clarity, the preferred allocations by vend space areas for the products A–H that are available in such vending machine, as specified and depicted in FIG. 57.

Figure 66:
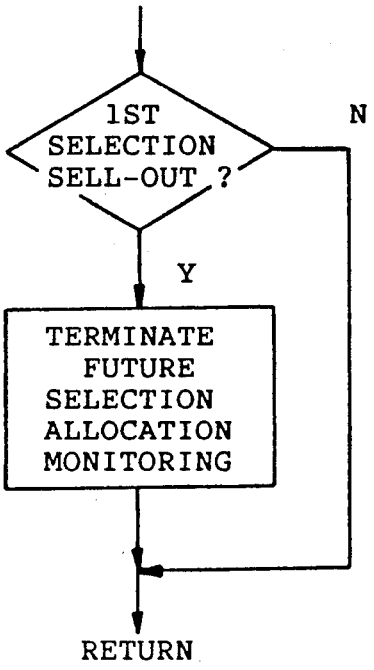
FIGS. 66 and 67 depict portions of typical subroutines that may be employed during the course of a vend operation while the vending machine is in sales mode to effect the recordation and retention of product selection information required by the selection allocation monitoring means of the present invention.
Figure 67:
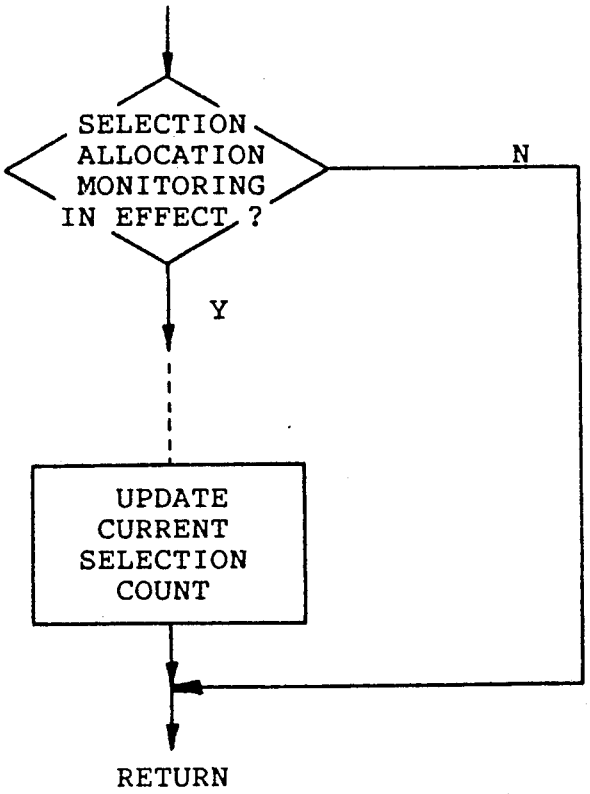
Figure 68:
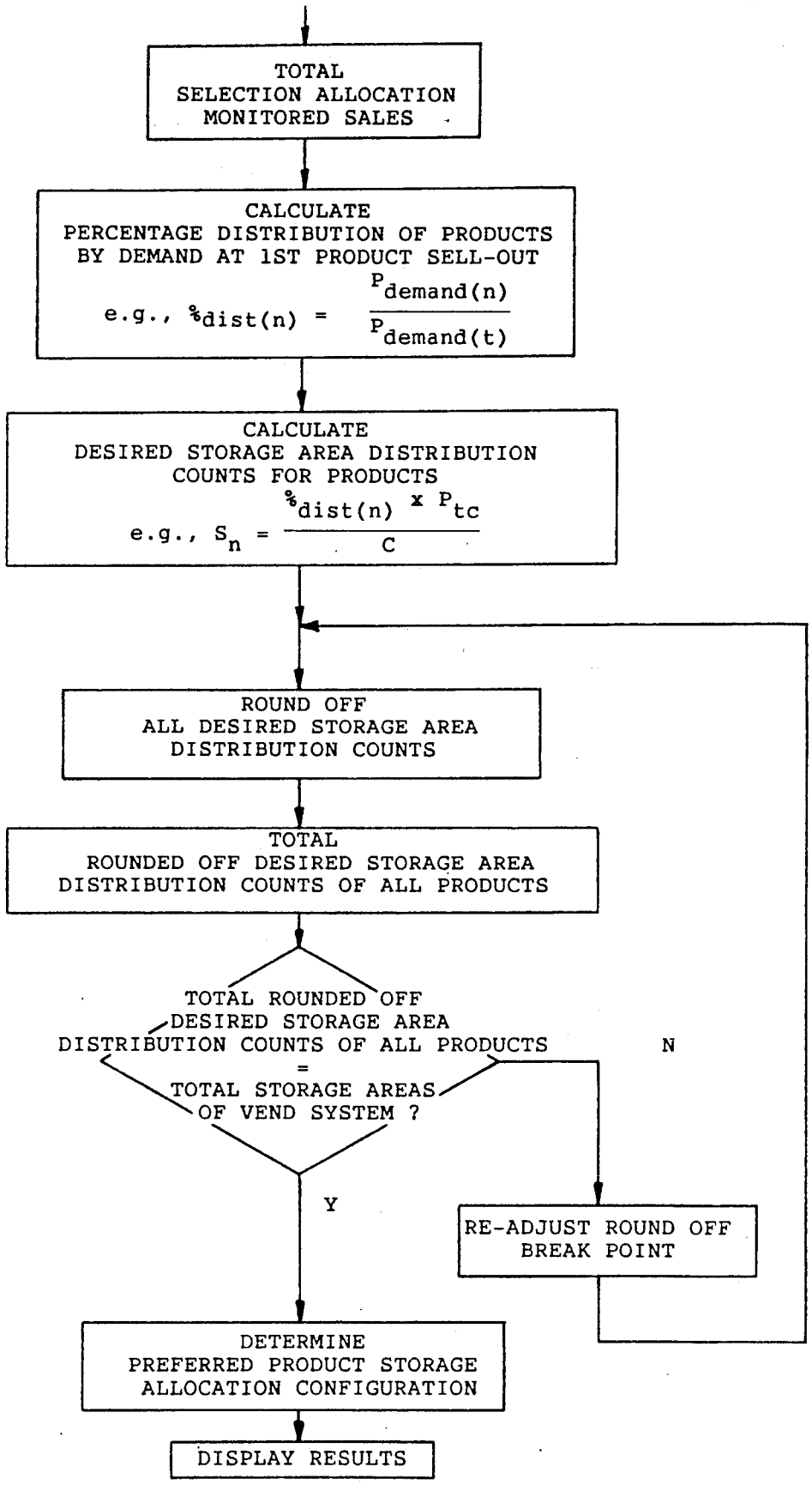
FIG. 68 depicts a portion of a typical subroutine that may be employed while the vending machine is in a service mode to determine and display a preferred vend space allocation configuration, based at least in part upon the monitored product demand.

It will be recognized from what has been discussed hereinbefore that it is important to the practice of this invention that a record of product demand be produced as products are being vended, that further production of such record be inhibited when any product first sells out, that a preferred vend space allocation configuration be determined from the recorded product demand for the various product types based upon system design, and that information indicative of the preferred vend allocation configuration be communicated to authorized personnel. FIGS. 66 and 67, corresponding to FIGS. 28 and 29 in Applicant's co-pending U.S. Pat. application Ser. No. 303,547, filed Jan. 27, 1989, depict typical subroutine portions that may be employed during the course of a vend operation while the vending machine is in a sales mode to, in the case of FIG. 66, terminate selection allocation monitoring, i.e., inhibit further product demand recording, when a first product sell-out has been detected, and to, in the case of FIG. 67, update the current selection count, i.e., increment the recorded product demand count for the particular product being vended. FIG. 68 depicts a representative subroutine portion of the type that might typically be employed during a service mode to determine a preferred vend space allocation configuration from the recorded product demand for the various product types based upon the system design and to communicate information indicative of such preferred vend space allocation configuration to authorized personnel, e.g., by displaying a desired storage area distribution count or, more preferably, space allocation information indicative of a preferred vend space allocation configuration.

Figure 42:
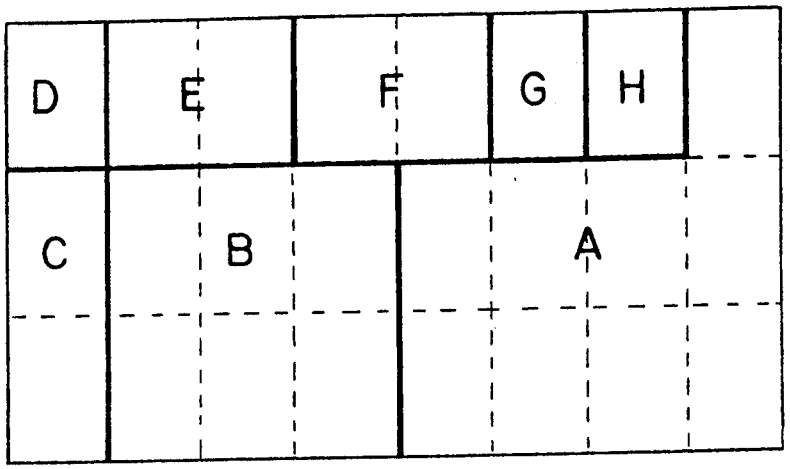
FIGS. 42–44 represent various preferred vend space allocation configurations of a vending machine constructed in accordance with FIGS. 1 and 7, which vend space allocation configurations were determined from FIGS. 27, 28–29, and 30–32, respectively.
Figure 43:
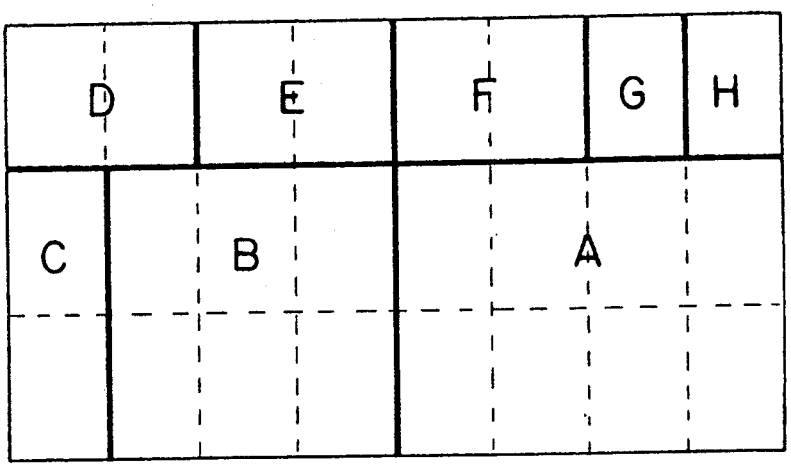
Figure 44:
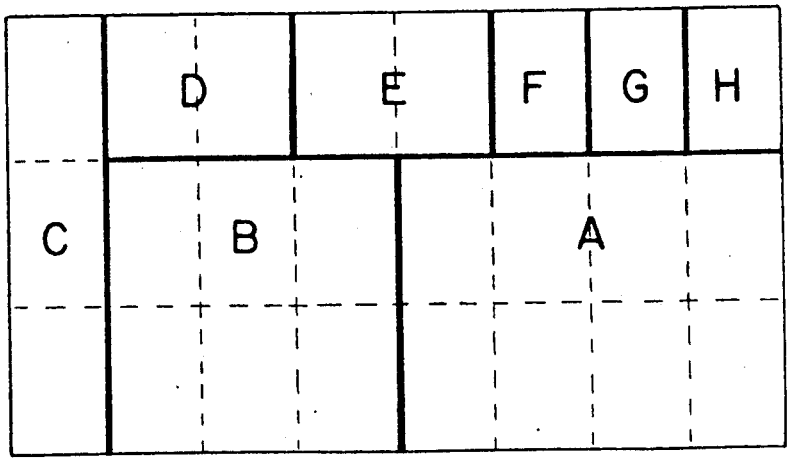

It should be noted that FIG. 68 depicts a typical subroutine of the type that might be employed with a vending system of the type discussed with regard to FIGS. 42–44, wherein the vending machine is constructed according to FIG. 1, with all of the columns 1'–8' being of depths to hold three products laid end-to-end in column portions a, b, and c thereof, as in FIG. 7, and all of the columns 1'–8' and their portions a, b, and c being of equal height such that equal numbers of products can be stacked in each of the portions a, b, and c of such columns, as a consequence of which the vending machine may be considered to have twenty-four storage areas of equal size. With other vending systems or with systems that employ vending machines wherein not all storage areas are of like size, the subroutine portions involving calculation of desired storage area distribution counts and development of a preferred vend product storage allocation configuration therefrom would be replaced by other portions, such as table look-ups and/or matchings of percentage distributions of products by historical demand against product storage capabilities and possibilities for such particular systems and/or vending machines, to develop a preferred vend space allocation configuration.

As has been previously discussed with reference to FIGS. 5–7, proper operation of the motor M' of the vend delivery system of Applicant's co-pending U.S. Pat. application Ser. No. 230,963, now U.S. Pat. No. 4,991,739, to advance the appropriate finger 94' to 95' to engage an appropriate escapement member 80', 380', or 480' to effect the delivery of the desired type of product can be readily achieved, especially with utilization of a microprocessor controlled vending system. By way of example only, and not by way of limitation, with the vending machine and vend space allocation configuration depicted in FIG. 57, the processing means of FIG. 8 could be programmed to, initially, effect vending of product A from columns 1–2 until such time as delivery sensor means 112 no longer detects a delivery of product A, whereupon delivery could then be effected from columns 3–4 until they became empty, and so on until all of columns 1–8 were emptied. The same principle would be applied with respect to the other products B–H, as well. Alternatively, if products of a given type are stored in a plurality of columns which are separately addressable for dispensing purposes, such columns may be addressed in a cyclical fashion, under program control, and delivery sensor means 112 can be employed to ensure that delivery of a product actually occurs or that a different column is addressed, until all columns holding such type of product have been emptied. From what has been said hereinbefore, it will thus be apparent to those skilled in the art that a wide variety of vend delivery methods and techniques can be employed and utilized in conjunction with the present invention.

In the foregoing discussions and examples the first sellout of a product type has served as a terminating event for the recordation of product demand data. It should be recognized, however, that the occurrence of other events may also serve as or constitute terminating events. For example, occasions may often arise where no product type sells out prior to machine servicing. In such cases, machine servicing may constitute the terminating event for product demand data recordation. In other settings, it may be desired that product demand data be recorded only for some set period of time, in which case the timing out of a timer or other timing means could constitute the terminating event for product demand recordation. As will be apparent from what has already been said, numerous other events could also serve as terminating events. In most of such instances, though, it will still be desired that sellout of a product type prior to the occurrence of an event that might otherwise be considered a terminating event would serve as an overriding terminating event. There may, however, even be exceptions to this. For example, the vending system could be so designed that the sellout of a product type would not be revealed to a customer until after he has made an appropriate product selection for the amount of credit entered. In such case, the processing means of the vending system might be programmed to update the product demand information in response to the first (and only the first) vend selection made during a vend operation, regardless of whether any product type is sold out. In such event, if a product type were sold out, the product request for the desired product would be noted and recorded, but any subsequent product request during the same vend operation, such as might typically be made by the customer after notification to him of the sold out condition of the desired product type, would not be counted on the grounds that it reflects only a substitute or secondary demand.

Actual updating of the recorded product demand data may be effected by the processing means at any appropriate time during the course of a vend operation, depending upon the particular vending systems, the period over which product demand data is desired, and the particular control program utilized or the particular control method followed. With a microprocessor controlled vending system the microprocessor may be programmed to be responsive to and of numerous events to effect an updating of the recorded product demand data, including such events as recognition of a vend selection, activation of the vend delivery means, or recognition of product delivery by the delivery sensor means, to name only a few.

It should also be appreciated that, although machine servicing will often include product restocking, machine servicing is not limited to product restocking, and servicing may sometimes not involve product restocking. In some instances servicing of the machine may involve the entry of data or information into the machine or the retrieval of some data or information therefrom apart from restocking, such as by means of the data entry means 104, the status monitor means 116, and/or the display means 108 of FIG. 8, perhaps even for the purpose of checking the consistency between product demand and product storage allocation before product restocking and/or product storage allocation is scheduled or becomes necessary, and, in certain instances, such information entry or retrieval, and operations dependent thereupon, may even involve or require the use of portable interrogation means, transmission and reception means, or phone lines or other data link means to remote devices of various types, all of which means and devices may, in such cases, form or be considered portions of the vend system of which the particular vending machine is also a part.

Also, it may be the case that, for some reason, the preferred vend product storage allocation configuration communicated by or according to the invention might, in some instances, be a configuration that is considered inappropriate or unacceptable. In such instances, service personnel may be permitted, such as by operation of the data entry means 104, to reject such preferred vend product storage allocation configuration or even to alter such preferred vend product storage allocation configuration to achieve a more acceptable configuration. It should be appreciated that, depending upon the particular vending system and/or vending machine involved, reconfiguration of the system or machine may involve anywhere from little or no manual reconfiguration to extensive repositioning of various elements necessary to effect a variation in the allocation configuration of the system and/or vending machine.

Additionally, although the means for communicating information to authorized personnel has generally been treated and discussed herein as being a visual display means, other communication means, including, without limitation as to other types, audio means of various types, could also be employed.

From the foregoing it will be apparent that there have been shown and described a vend space allocation monitor means and method, which means and method fulfill the objects and advantages sought therefor. It will be further apparent to those skilled in the art that many embodiments other than the preferred forms discussed herein and many variations of the method other than those described herein are also possible and contemplated, including many changes in, modifications to, and other uses and applications of the subject vend space allocation monitor means and method. All such embodiments, variations, changes, modifications, and other uses and applications that do not depart from the spirit and scope of this invention are deemed to be covered by this invention, which is limited only by the claims which follow.

What is claimed is:

1. Vend space allocation means for allocating a greater number of product storage areas to a lesser number of classes of selectable vendable products for a vending system capable of vending from among a plurality of classes of selectable vendable products a product from a selected product class, which vending system has a plurality of product storage areas for vend product storage and an established vend space allocation configuration allocating the product storage areas to the classes of selectable vendable products, said vend space allocation means comprising a vend selection monitoring means for monitoring over a period of time the historical demand for the various classes of selectable vendable products, means for determining, based at least in part upon said historical demand, a preferred allocation of such greater number of product storage areas to the lesser number of classes of vendable products whereby maximally contemporaneous sellout of the various classes of products by such vending system would be anticipated for substantially fully loaded storage areas and a continuing unchanged product demand, and means for communicating to authorized personnel such determination.

2. The vend space allocation means of claim 1 wherein said vend selection monitoring means includes data storage means for storing historical demand data representative of the historical demand over the period of time for the plurality of classes of selectable vendable products and said determining means includes means for retrieving said historical demand data.

3. The vend space allocation means of claim 2 wherein said historical demand data upon which such determination is based is the historical demand data for the period of time prior to the first sellout of any class of selectable vendable product.

4. The vend space allocation means of claim 2 including a processing means, said processing means forming portions of said vend selection monitoring means and said determining means.

5. The vend space allocation means of claim 4 wherein said vend selection monitoring means includes vend selection entry means and said processing means is operable during vending operations to update the historical demand data stored in said data storage means to reflect the vend selection for each product vend operation.

6. The vend space allocation means of claim 5 wherein said vend selection monitoring means includes means for monitoring the product availability status for each class of selectable vendable products and for detecting when a class of selectable vend products becomes sold out, said processing means being responsive to the detection of the first sold out condition for a class of selectable vendable products to prevent further updating during subsequent vending operations of historical demand data stored in said data storage means.

7. The vend space allocation means of claim 5 wherein the vending system includes credit entry means and said processing means is responsive to the detection of a vend selection for which sufficient credit has been entered to effect the updating of said historical demand data.

8. The vend space allocation means of claim 5 wherein the vending system includes vend means and said processing means is operable to effect the updating of said historical demand data when operation of the vend means is effected by said processing means.

9. The vend space allocation means of claim 5 wherein said vend selection monitoring means includes delivery sensor means for detecting delivery of a product, said processing means being responsive to the detection of a product delivery to effect the updating of said historical demand data.

10. The vend space allocation means of claim 5 wherein said processing means includes memory means for storing data therein and means for retrieving such data therefrom, said data storage means for storing historical demand data forming a portion of said memory means, said memory means also including a portion thereof for storing system design data, and wherein, upon the occurrence of a terminating event, said processing means is operable to determine from said historical demand data and from said system design data stored in said memory means space allocation information indicative of a preferred vend space allocation configuration for the vending system.

11. The vend space allocation means of claim 10 wherein servicing of the vending system constitutes said terminating event.

12. The vend space allocation means of claim 11 wherein the vending system is operable in a vending mode of operation and in a service mode of operation, initiation of a service mode of operation constituting said terminating event.

13. The vend space allocation means of claim 10 wherein the vending system includes means for detecting a machine condition indicative of a service mode of operation of the vending system, said processing means operatively connected to such detecting means and responsive to detection of a machine condition indicative of a service mode of operation to determine said space allocation information indicative of a preferred vend space allocation configuration for the vending system.

14. The vend space allocation means of claim 13 wherein the means for detecting a machine condition includes status monitor means and the machine condition indicative of a service mode of operation is a vendor door open condition.

15. The vend space allocation means of claim 10 wherein the vending system includes service information entry means for entering service information, said processing means operatively connected to the service information entry means and responsive to entry of service information to determine said space allocation information indicative of a preferred vend space allocation configuration for the vending system, the entry of such service information constituting said terminating event.

16. The vend space allocation means of claim 10 wherein the first sellout of a class of selectable vendable products constitutes said terminating event.

17. The vend space allocation means of claim 10 wherein said terminating event for a given period of time is the first event to occur from among a plurality of possible terminating events.

18. The vend space allocation means of claim 17 wherein said possible terminating events include both first sellout of a class of selectable vendable products and servicing of the vending system.

19. The vend space allocation means of claim 17 wherein said vend selection monitoring means includes timing means and one of said possible terminating events is the timing out of said timing means.

20. The vend space allocation means of claim 5 wherein the vending system includes credit entry means and said processing means is responsive to the first vend selection entered during a vend operation for a credit entry of an amount sufficient for the vend cost of such vend selection to update said historical demand data.

21. The vend space allocation means of claim 20 wherein said processing means includes memory means for storing data therein and means for retrieving such data therefrom, said data storage means for storing historical demand data forming a portion of said memory means, said memory means also including a portion thereof for storing system design data, and wherein, upon the occurrence of a terminating event, said processing means is operable to determine from said historical demand data and from said system design data stored in said memory means space allocation information indicative of a preferred vend space allocation configuration for the vending system.

22. The vend space allocation means of claim 21 wherein servicing of the vending system constitutes said terminating event.

23. The vend space allocation means of claim 21 wherein the vending system is operable in a vending mode of operation and in a service mode of operation, initiation of a service mode of operation constituting said terminating event.

24. The vend space allocation means of claim 21 wherein said vend selection monitoring means includes timing means and the timing out of said timing means constitutes said terminating event.

25. The vend space allocation means of claim 21 wherein said terminating event for a given period of time is the first event to occur from among a plurality of possible terminating events.

26. The vend space allocation means of claim 10 wherein said processing means is operable to calculate for each class of selectable vendable products a proportionate demand value representative of the percentage distribution by demand of such class of products and to determine therefrom vend space allocation information indicative of said preferred vend space allocation configuration for the vending system.

27. The vend space allocation means of claim 26 wherein said processing means is operable to effect communication to authorized personnel of said space allocation information indicative of said preferred vend space allocation configuration by said means for communicating.

28. The vend space allocation means of claim 27 wherein said means for communicating includes means for visually indicating said space allocation information.

29. The vend space allocation means of claim 28 wherein said means for visually indicating said space allocation information includes light means.

30. The vend space allocation monitor means of claim 29 wherein said light means includes a plurality of lights, each product storage area having a light associated therewith.

31. The vend space allocation means of claim 28 wherein said means for visually indicating said space allocation information includes alphanumeric display means for displaying said space allocation information.

32. The vend space allocation means of claim 27 wherein said means for communicating includes audio means.

33. The vend space allocation means of claim 27 wherein said means for communicating includes means operable by authorized personnel to effect such communication of said space allocation information.

34. The vend space allocation means of claim 10 wherein the vending system includes means operable to place such system in a service mode of operation, said processing means operable when the vending system is in a service mode of operation to effect, based upon said stored historical demand data and said stored system design data, communication to authorized personnel by said means for communicating of said vend space allocation information indicative of said preferred vend space allocation configuration for the vending system.

35. The vend space allocation means of claim 34 wherein the vending system includes data entry means operable by authorized personnel while the vending system is in a service mode of operation to provide data to said processing means and wherein said processing means is responsive to the receipt of such data to effect such communication of said space allocation information.

36. The vend space allocation means of claim 35 wherein said means for communicating includes a display means.

37. The vend space allocation means of claim 4 wherein said processing means includes memory means for storing data therein and means for retrieving such data therefrom, said data storage means for storing historical demand data forming a Portion of said memory means, said memory means also including a portion thereof for storing system design data, said processing means also including a microprocessor programmed to:

(A) update the historical demand data stored in said data storage means to reflect the vend selection for each product vend operation while the vending system is in a vending mode of operation until the occurrence of a terminating event, (B) respond to the occurrence of a terminating event to prevent further updating of historical demand data stored in said data storage means, (C) determine from said historical demand data and from said system design data stored in said memory means space allocation information indicative of said preferred vend space allocation configuration for the vending system, (D) effect communication to authorized personnel by said means for communicating of said space allocation information indicative of said preferred vend space allocation configuration.

38. The vend space allocation means of claim 37 wherein servicing of the vending system constitutes said terminating event.

39. The vend space allocation means of claim 37 wherein the vending system includes service information entry means for entering service information, said processing means operatively connected to the service information entry means and responsive to entry of service information to determine said space allocation information indicative of said preferred vend space allocation configuration, the entry of such service information constituting said terminating event.

40. The vend space allocation means of claim 37 wherein the first sellout of a class of selectable vendable products constitutes said terminating event.

41. The vend space allocation means of claim 37 wherein said terminating event for a given period of time is the first event to occur from among a plurality of possible terminating events.

42. The vend space allocation means of claim 41 wherein said possible terminating events include both first sellout of a class of selectable vendable products and servicing of the vending system.

43. The vend space allocation means of claim 37 wherein said selection monitoring means includes timing means and one of said possible terminating events is the timing out of said timing means.

44. The vend space allocation means of claim 37 wherein said microprocessor is programmed in performing step (C) to:

(1) calculate for each class of selectable vendable products a proportionate demand value representative of the percentage distribution by demand for such class of selectable vendable products, and (2) determine from said proportionate demand values and from said system design data said space allocation information.

45. The vend space allocation means of claim 44 wherein result data is obtained in the performance of step (2), said result data being indicative of the allocation of specific product storage areas for storage of specific classes of products.

46. The vend space allocation monitor means of claim 45 wherein said microprocessor is programmed in performing step (D) to effect communication to authorized personnel by said means for communicating of said result data.

47. The vend space allocation means of claim 4 wherein said processing means includes memory means for storing data therein and means for retrieving such data therefrom, said data storage means for storing historical demand data forming a portion of said memory means, said memory means also including a portion thereof for storing system design data, said processing means also including a microprocessor programmed to operate, first, during a vending mode of operation, to:

(A) update the historical demand data stored in said data storage means to reflect the vend selection for each product vend operation until any class of selectable vendable products has first become sold out, and (B) respond to any detection of a first sold out condition for a class of selectable vendable products to prevent further updating during subsequent vending operations of historical demand data stored in said means for storing historical demand data, and, subsequently, during a service mode of operation, to:

(C) determine from said historical demand data and from said system design data stored in said memory means said space allocation information indicative of said preferred vend space allocation configuration, and (D) effect communication to authorized personnel by said means for communicating of said space allocation information.

48. The vend space allocation means of claim 47 wherein the vending system includes means for detecting a machine condition indicative of a service mode status and said processing means is operatively connected to such detecting means, and wherein said processing means is responsive to detection of a machine condition indicative of a service mode status to cause the vending system to enter a service mode of operation.

49. The vend space allocation means of claim 48 wherein the means for detecting a machine condition includes status monitor means and the machine condition indicative of a service mode of operation is a vendor door open condition.

50. The vend space allocation means of claim 47 wherein the vending system includes data entry means operable by authorized personnel to enter service information and said processing means is operatively connected to the data entry means, and wherein said processing means is responsive to service information entered at the data entry means to cause the vending system to enter a service mode of operation.

51. The vend space allocation means of claim 4 wherein the vending system includes vend means and said processing means is operable to effect the updating of said historical demand data when operation of the vend means is effected by said processing means.

52. The vend space allocation means of claim 4 wherein said vend selection monitoring means includes delivery sensor means for detecting delivery of a product, said processing means being responsive to the detection of a product delivery to effect the updating of said historical demand data.

53. The vend space allocation means of claim 4 wherein said processing means includes memory means for storing data therein and means for retrieving such data therefrom, said data storage means for storing historical demand data forming a portion of said memory means, said memory means also including a portion thereof for storing system design data, and wherein, upon the occurrence of a terminating event, said processing means is operable to determine from said historical demand data and from said system design data stored in said memory means said space allocation information indicative of said preferred vend space allocation configuration.

54. The vend space allocation means of claim 53 wherein said processing means is operable to calculate for each class of selectable vendable products a proportionate demand value representative of the percentage distribution by demand of such class of selectable vendable products and to determine therefrom result data indicative of the allocation of specific product storage areas for storage of specific classes of products.

55. The vend space allocation means of claim 53 wherein the vending system includes means operable to place such system in a service mode of operation, said processing means operable when the vending system is in a service mode of operation to effect communication to authorized personnel by said means for communicating of said space allocation information.

56. Vend space allocation means for allocating based upon historical demand product storage areas in a vending system that has a plurality of distinguishable product storage areas for storage prior to bending of a plurality of distinguishable types of vendable products, wherein the number of distinguishable product storage areas exceeds the number of distinguishable types of vendable products intended to be vended by such vending system and wherein at least certain of the distinguishable product storage areas are configurable with one another to permit the vending of a common type of vendable product therefrom, such vending system including means operable to establish and form from the plurality of distinguishable product storage areas a plurality of product storage compartments, each such storage compartment adapted to hold therein a plurality of products of a given type, means for dispensing from each such storage compartment the products stored therein, means for controlling in response to an authorized request the dispensing of a requested distinguishable type of vendable product, and data storage means for storing historical demand data for each distinguishable type of vendable product, said vend space allocation means comprising information entry means operable to effect a vend space allocation operation, processing means operatively connected to said information entry means to be response to such operation of said information entry means and operatively connected to the means for storing historical demand data to retrieve historical demand data therefrom, and display means, said processing means responsive to an initial authorized operation of said information entry means to initiate a vend space allocation operation, said processing means thereafter operable to determine for each type of distinguishable product a proportionate demand value based upon the historical demand data stored in said data storage means, to determine for each type of distinguishable product based upon such proportionate demand values space allocation information identifying one or more product storage areas configurable to form a product storage compartment therefor, and to effect the display by said display means of such space allocation information, wherein such space allocation information determines a preferred allocation of such number of distinguishable product storage areas to the number of distinguishable types of vendable products whereby maximally contemporaneous sellout of the various types of products by such vending system would be anticipated for substantially fully loaded storage areas and a continuing unchanged product demand.

57. The vend space allocation means of claim 56 wherein said information entry means is operable during a vend space allocation operation to enter selected information thereat and wherein said processing means is responsive to the entry of such selected information to determine revised space allocation information dependent upon the selected information entered and to effect the display by said display means of such revised space allocation information.

58. The vend space allocation means of claim 56 including allocation information storage means for storing allocation information determined by said processing means, the means for controlling the dispensing of a requested distinguishable type of vendable product being operatively connected to retrieve allocation information from said allocation information storage means.

59. The vend space allocation means of claim 56 including configuration variation data storage means for storing configuration variation data particular to the vending system and indicative of various possible configuration variations for the plurality of vend storage areas of such vending system, said processing means being operatively connected to retrieve configuration variation data from the configuration variation data storage means, said processing means operable to retrieve from said configuration variation data storage means specific configuration variation data representative of a possible vending system configuration in accordance with the particular proportionate demand values determined by said processing means during the vend space allocation operation.

60. The vend space allocation means of claim 59 wherein the stored configuration variation data comprises a look-up table.

61. The vend space allocation means of claim 56 wherein said processing means includes a microprocessor.

62. The vend space allocation means of claim 61 including configuration variation data storage means for storing configuration variation data particular to the vending system and indicative of various possible configuration variations for the plurality of vend storage areas of such vending system, said processing means being operatively connected to retrieve configuration variation data from the configuration variation data storage means, and wherein said microprocessor is programmed to perform during a vend space allocation operation the steps of:

(A) retrieving the historical demand data for each type of distinguishable product and calculating therefrom a proportionate demand value for each type of distinguishable product corresponding to the demand for such given type of distinguishable product during a period of time divided by the total demand for all types of distinguishable products during such period of time, (B) retrieving from said configuration variation data storage means specific configuration variation data representative of a possible vending system configuration in accordance with the particular proportionate demand values calculated in step (A), (C) effecting the display by said display means of such specific configuration variation data.

63. Vend space allocation means for allocating based upon historical demand product vend storage areas in a vending system that has a plurality of separable product storage areas for storage prior to vending of a plurality of distinguishable types of vendable products, wherein the number of separable product storage areas exceeds the number of distinguishable types of vendable products intended to be vended by such vending system and wherein at least certain of the separable product storage areas are configurable with one another to permit the vending of a common type of vendable product therefrom, such vending system including configuration means operable to establish and form from the plurality of separable product storage areas a plurality of product storage compartments, each such storage compartment adapted to hold therein a plurality of products of a given type, means for dispensing from each such storage compartment the products stored therein, means for controlling in response to an authorized request the dispensing of a requested distinguishable type of vendable product, and data storage means for storing historical demand data for each distinguishable type of vendable product, said vend space allocation means comprising information entry means operable by authorized personnel to effect a vend space allocation operation, processing means operatively connected to said information entry means to be responsive to such operation of said information entry means and operatively connected to the means for storing historical demand data to retrieve historical demand data therefrom, said processing means responsive to an initial authorized operation of said information entry means to initiate a vend space allocation operation, said processing means thereafter operable to establish based upon said historical demand data a preferred vend space allocation configuration whereby each distinguishable type of vendable product has associated therewith one or more product storage areas configurable to form a product storage compartment therefor and maximally contemporaneous sellout of the various types of products by such vending system would be anticipated for substantially fully loaded storage areas and a continuing unchanged product demand.

64. Vend space allocation means for a vending system that has a plurality of distinguishable product storage areas for storage prior to vending of a plurality of distinguishable types of vendable products, wherein the number of distinguishable product storage areas exceeds the number of distinguishable types of vendable products intended to be vended by such vending system and wherein at least certain of the distinguishable product storage areas are configurable with one another to permit the vending of a common type of vendable product therefrom, such vending system including means operable by authorized personnel to establish and form from the plurality of distinguishable product storage areas a plurality of product storage allocation areas, each such product storage allocation area adapted to hold therein a plurality of products of a given type, the plurality of product storage allocation areas so established defining an established vend space allocation configuration, means for dispensing from each such product storage allocation area the products stored therein, means for controlling in response to an authorized request the dispensing of a requested distinguishable type of vendable product, and data storage means for storing historical demand data for each distinguishable type of vendable product, said vend space allocation monitor means comprising vend selection monitoring means for monitoring over a period of time the historical demand for the various types of vendable products, processing means operatively connected to said vend selection monitoring means and said data storage means and operable as product demand is monitored to update said historical demand data stored in said data storage means to refelct teh historical demand for the various types of vendable products, and communication means, said processing means operable in response to a terminating event for the time period to determine, based upon the historical demand data stored in said data storage means, a preferred allocation of such greater number of product storage are as to the lesser number of types of vendable products whereby maximally contemporaneous sellout of the various types of products by such vending system would be anticipated for substantially fully loaded storage areas and a continuing unchanged product demand, and to effect the communication to authorized personnel by said communication means of information indicative of such determination.

65. The vend space allocation means of claim 64 wherein servicing of the vending system constitutes said terminating event.

66. The vend space allocation means of claim 64 wherein the vending system is operable in a vending mode of operation and in a service mode of operation, initiation of a service mode of operation constituting said terminating event.

67. The vend space allocation means of claim 64 wherein the vending system includes means for detecting a machine condition indicative of a service mode of operation of the vending system, said processing means operatively connected to such detecting means and responsive to detection of a machine condition indicative of a service mode of operation to determine said preferred allocation.

68. The vend space allocation means of claim 64 wherein the vending system includes service information entry means for entering service information, said processing means operatively connected to the service information entry means and responsive to entry of service information to determine said preferred allocation, the entry of such service information constituting said terminating event.

69. The vend space allocation means of claim 64 wherein the first sellout of a class of selectable vendable products constitutes said terminating event.

70. The vend space allocation means of claim 64 wherein said terminating event for a given period of time is the first event to occur from among a plurality of possible terminating events.

71. The vend space allocation means of claim 70 wherein said possible terminating events include both first sellout of a class of selectable vendable products and servicing of the vending system.

72. The vend space allocation means of claim 70 wherein said vend selection monitoring means includes timing means and one of said possible terminating events is the timing out of said timing means.

73. A method for determining and for communicating to authorized personnel a preferred vend space allocation configuration allocating a greater number of product storage area to a lesser number of classes of selectable vendable products for a vending system capable of vending from among a plurality of classes of selectable vendable products a product from a selected product class, which vending system has a plurality of product storage areas for vend product storage, an established vend space allocation configuration allocating the product storage areas to the classes of selectable vendable products, and communication means, comprising the steps of:

(A) recording and updating for product vend operations as products are vended over a period of time the product demand by class of product, (B) determining from said recorded product demand for such period of time a preferred allocation of such greater number of product storage areas to the lesser number of classes of vendable products whereby maximally contemporaneous sellout of the various classes of products by such ending system would be anticipated for substantially fully loaded storage areas and a continuing unchanged product demand, and (C) effecting communication by such communication means of space allocation information identifying said preferred allocation to authorized personnel.

74. The method of claim 73 wherein step (A) is terminated by the occurrence of a terminating event.

75. The method of claim 74 wherein servicing of the vending system constitutes said terminating event.

76. The method of claim 74 wherein the vending system is operable in a vending mode of operation and in a service mode of operation, initiation of a service mode of operation constituting said terminating event.

77. The method of claim 74 wherein the first sellout of a class of selectable vendable products constitutes said terminating event.

78. The method of claim 74 wherein said terminating event for a given period of time is the first event to occur from among a plurality of possible terminating events.

79. The method of claim 78 wherein said possible terminating events include both first sellout of a class of selectable vendable products and servicing of the vending system.

80. The method of claim 78 wherein said selection monitoring includes timing means and one of said possible terminating events is the timing out of said timing means.

81. A method for determining and for communicating to authorized personnel a preferred vend space allocation configuration allocating a greater number of product storage area to a lesser number of classes of selectable vendable products for a vending system capable of vending from among a plurality of classes of selectable vendable products a product from a selected product class, which vending system has a plurality of product storage areas for vend product storage and an established vend space allocation configuration allocating the product storage areas to the classes of selectable vendable products, comprising the steps of:

(A) providing means for monitoring and recording product demand and for communicating information to authorized personnel.

(B) monitoring the demand for the various classes of selectable vendable products over a period of time and recording such historical demand, (C) determining, based at least in part upon said historical demand, a preferred allocation of such greater number of product storage areas to the lesser number of classes of vendable products whereby maximally contemporaneous sellout of the various classes of products by such vending system would be anticipated for substantially fully loaded storage areas and a continuing unchanged product demand, and (D) communicating such determination to authorized personnel.

82. A method of allocating, based upon historical demand, product vend storage areas in a vending system that has a plurality of distinguishable product storage areas for storage prior to vending of a plurality of distinguishable types of vendable products, wherein the number of distinguishable product storage areas exceeds the number of distinguishable types of vendable products intended to be vended by such vending system and wherein at least certain of the distinguishable product storage areas are configurable with one another to permit the vending of a common type of vendable product therefrom, such vending system including configuration means operable to establish and form from the plurality of distinguishable product storage areas a plurality of product storage compartments, each such storage compartment adapted to hold therein a plurality of products of a given type, means for dispensing from each such storage compartment the products stored therein, means for controlling in response to an authorized request the dispensing of a requested distinguishable type of vendable product, and data storage means for storing historical demand data for each distinguishable type of vendable product, including the steps of (A) accumulating and storing over a period of time historical demand data for each distinguishable type of vendable product, (B) retrieving the historical demand data for each type of distinguishable product and calculating therefrom a proportionate demand value for each type of distinguishable product, (C) determining a preferred space allocation configuration based upon the particular proportionate demand values calculated in step (B), which allocation configuration allocates such greater number of product storage areas to the lesser number of classes of vendable products whereby maximally contemporaneous sellout of the various classes of products by such vending system would be anticipated for substantially fully loaded storage areas and a continuing unchanged product demand.

(D) effecting operation of the configuration means to configure the vending system to the desired vending system configuration.

83. Vend space allocation means for a vending system capable of vending from among a plurality of classes of selectable vendable products a product from a selected product class, which vending system has a plurality of product storage areas for vend product storage and an established vend space allocation configuration allocating the product storage areas to the classes of selectable vendable products, said vend space allocation means comprising a vend selection monitoring means for monitoring over a period of time the historical demand for the various classes of selectable vendable products, means for determining, based at least in part upon said historical demand, space allocation information indicative of a preferred vend space allocation configuration for the vending system, and means for communicating to authorized personnel such determination, said vend selection monitoring means including data storage means for storing historical demand data representative of the historical demand over the period of time for the plurality of classes of selectable vendable products and said determining means including means for retrieving said historical demand data, said vend space allocation means further including a processing means, said processing means forming portions of said vend selection monitoring means and said determining means, said vend selection monitoring means including vend selection entry means and said processing means being operable during vending operations to update the historical demand data stored in said data storage means to reflect the vend selection for each product vend operation, said vend selection monitoring means also including means for monitoring the product availability status for each class of selectable vendable products and for detecting when a class of selectable vend products becomes sold out, said processing means being responsive to the detection of the first sold out condition for a class of selectable vendable products to prevent further updating during subsequent vending operations of historical demand data stored in said data storage means.

84. Vend space allocation means for a vending system capable of vending from among a plurality of classes of selectable vendable products a product from a selected product class, which vending system has a plurality of product storage areas for vend product storage and an established vend space allocation configuration allocating the product storage areas to the classes of selectable vendable products, said vend space allocation means comprising a vend selection monitoring means for monitoring over a period of time the historical demand for the various classes of selectable vendable products, means for determining, based at least in part upon said historical demand, space allocation information indicative of a preferred vend space allocation configuration for the vending system, and means for communicating to authorized personnel such determination, said vend selection monitoring means including data storage means for storing historical demand data representative of the historical demand over the period of time for the plurality of classes of selectable vendable products and said determining means including means for retrieving said historical demand data, said vend space allocation means further including a processing means, said processing means forming portions of said vend selection monitoring means and said determining means, said vend selection monitoring means including vend selection entry means and said processing means being operable during vending operations to update the historical demand data stored in said data storage means to reflect the vend selection for each product vend operation, said processing means including memory means for storing data therein and means for retrieving such data therefrom, said data storage means for storing historical demand data forming a portion of said memory means, said memory means also including a portion thereof for storing system design data, and wherein, upon the occurrence of a terminating event, said processing means is operable to determine from said historical demand data and from said system design data stored in said memory means said space allocation information indicative of a preferred vend space allocation configuration for the vending system, the first sellout of a class of selectable vendable products constituting said terminating event.

85. Vend space allocation means for a vending system capable of vending from among a plurality of classes of selectable vendable products a product from a selected product class, which vending system has a plurality of product storage areas for vend product storage and an established vend space allocation configuration allocating the product storage areas to the classes of selectable vendable products, said vend space allocation means comprising a vend selection monitoring means for monitoring over a period of time the historical demand for the various classes of selectable vendable products, means for determining, based at least in part upon said historical demand, space allocation information indicative of a preferred vend space allocation configuration for the vending system, and means for communicating to authorized personnel such determination, said vend selection monitoring means including data storage means for storing historical demand data representative of the historical demand over the period of time for the plurality of classes of selectable vendable products and said determining means including means for retrieving said historical demand data, said vend space allocation means further including a processing means, said processing means forming portions of said vend selection monitoring means and said determining means, said vend selection monitoring means including vend selection entry means and said processing means being operable during vending operations to update the historical demand data stored in said data storage means to reflect the vend selection for each product vend operation, said processing means including memory means for storing data therein and means for retrieving such data therefrom, said data storage means for storing historical demand data forming a portion of said memory means, said memory means also including a portion thereof for storing system design data, and wherein, upon the occurrence of a terminating event, said processing means is operable to determine from said historical demand data and from said system design data stored in said memory means said space allocation information indicative of a preferred vend space allocation configuration for the vending system, said terminating event for a given period of time being the first event to occur from among a plurality of possible terminating events wherein said possible terminating events include both first sellout of a class of selectable vendable products and servicing of the vending system.

86. Vend space allocation means for a vending system capable of vending from among a plurality of classes of selectable vendable products a product from a selected product class, which vending system has a plurality of product storage areas for vend product storage and an established vend space allocation configuration allocating the product storage areas to the classes of selectable vendable products, said vend space allocation means comprising a vend selection monitoring means for monitoring over a period of time the historical demand for the various classes of selectable vendable products, means for determining, based at least in part upon said historical demand, space allocation information indicative of a preferred vend space allocation configuration for the vending system, and means for communicating to authorized personnel such determination, said vend selection monitoring means including data storage means for storing historical demand data representative of the historical demand over the period of time for the plurality of classes of selectable vendable products and said determining means including means for retrieving said historical demand data, said vend space allocation means further including a processing means, said processing means forming portions of said vend selection monitoring means and said determining means, said processing means including memory means for storing data therein and means for retrieving such data therefrom, said data storage means for storing historical demand data forming a portion of said memory means, said memory means also including a portion thereof for storing system design data, said processing means also including a microprocessor programmed to:

(A) update the historical demand data stored in said data storage means to reflect the vend selection for each product vend operation while the vending system is in a vending mode of operation until the occurrence of a terminating event, (B) respond to the occurrence of a terminating event to prevent further updating of historical demand data stored in said data storage means, (C) determine from said historical demand data and from said system design data stored in said memory means said space allocation information indicative of said preferred vend space allocation configuration for the vending system, (D) effect communication to authorized by said means for communicating of said space allocation information indicative of said preferred vend space allocation configuration, and wherein the first sellout of a class of selectable vendable products constitutes said terminating event.

87. Vend space allocation means for a vending system capable of vending from among a plurality of classes of selectable vendable products a product from a selected product class, which vending system has a plurality of product storage areas for vend product storage and an established vend space allocation configuration allocating the product storage areas to the classes of selectable vendable products, said vend space allocation means comprising a vend selection monitoring means for monitoring over a period of time the historical demand for the various classes of selectable vendable products, means for determining, based at least in part upon said historical demand, space allocation information indicative of a preferred vend space allocation configuration for the vending system, and means for communicating to authorized personnel such determination, said vend selection monitoring means including data storage means for storing historical demand data representative of the historical demand over the period of time for the plurality of classes of selectable vendable products and said determining means including means for retrieving said historical demand data, said vend space allocation means further including a processing means, said processing means forming portions of said vend selection monitoring means and said determining means, said processing means including memory means for storing data therein and means for retrieving such data therefrom, said data storage means for storing historical demand data forming a portion of said memory means, said memory means also including a portion thereof for storing system design data, said processing means also including a microprocessor programmed to:

(A) update the historical demand data stored in said data storage means to reflect the vend selection for each product vend operation while the vending system is in a vending mode of operation until the occurrence of a terminating event, (B) respond to the occurrence of a terminating event to prevent further updating of historical demand data stored in said data storage means, (C) determine from said historical demand data and from said system design data stored in said memory means said space allocation information indicative of said preferred vend space allocation configuration for the vending system, (D) effect communication to authorized personnel by said means for communication of said space allocation information indicative of said preferred vend space allocation configuration.

and wherein said terminating event for a given period of time is the first event to occur from among a plurality of possible terminating events, said possible terminating events including both first sellout of a class of selectable vendable products and servicing of the vending system.

88. Vend space allocation means for a vending system capable of vending from among a plurality of classes of selectable vendable products a product from a selected product class, which vending system has a plurality of product storage areas for vend product storage and an established vend space allocation configuration allocating the product storage areas to the classes of selectable vendable products, said vend space allocation means comprising a vend selection monitoring means for monitoring over a period of time the historical demand for the various classes of selectable vendable products, means for determining, based at least in part upon said historical demand, space allocation information indicative of a preferred vend space allocation configuration for the vending system, and means for communicating to authorized personnel such determination, said vend selection monitoring means including data storage means for storing historical demand data representative of the historical demand over the period of time for the plurality of classes of selectable vendable products and said determining means including means for retrieving said historical demand data, said vend space allocation means further including a processing means, said processing means forming portions of said vend selection monitoring means and said determining means, said processing means including memory means for storing data therein and means for retrieving such data therefrom, said data storage means for storing historical demand data forming a portion of said memory means, said memory means also including a portion thereof for storing system design data, said processing means also including a microprocessor programmed to operate, first, during a vending mode of operation, to:

(A) update the historical demand data stored in said data storage means to reflect the vend selection for each product vend operation until any class of selectable vendable products has first become sold out, and (B) respond to any detection of a first sold out condition for a class of selectable vendable products to prevent further updating during subsequent vending operations of historical demand data stored in said means for storing historical demand data, and, subsequently, during a service mode of operation, to:

(C) determine from said historical demand data and from said system design data stored in said memory means said space allocation information indicative of said preferred vend space allocation configuration, and (D) effect communication to authorized personnel by said means for communicating of said space allocation information.

89. The vend space allocation means of claim 88 wherein the vending system includes means for detecting a machine condition indicative of a service mode status and said processing means is operatively means is responsive to detection of a machine condition indicative of a service mode status to cause the vending system to enter a service mode of operation.

90. The vend space allocation means of claim 89 wherein the means for detecting a machine condition includes status monitor means and the machine condition indicative of a service mode of operation is a vendor door open condition.

91. The vend space allocation means of claim 88 wherein the vending system includes data entry means operable by authorized personnel to enter service information and said processing means is operatively connected to the data entry means, and wherein said processing means is responsive to service information entered at the data entry means to cause the vending system to enter a service mode of operation.

92. Vend space allocation means for a vending system that has a plurality of distinguishable product storage areas for storage prior to vending of a plurality of distinguishable types of vendable products, wherein the number of distinguishable product storage areas exceeds the number of distinguishable types of vendable products intended to be vended by such vending system and wherein at least certain of the distinguishable product storage areas are configurable with one another to permit the vending of a common type of vendable product therefrom, such vending system including means operable by authorized personnel to establish and form from the plurality of distinguishable product storage areas a plurality of product storage allocation areas, each such product storage allocation area adapted to hold therein a plurality of products of a given type, the plurality of product storage allocation areas so established defining an established vend space allocation configuration, means for dispensing from each such product storage allocation area the products stored therein, means for controlling in response to an authorized request the dispensing of a requested distinguishable type of vendable product, and data storage means for storing historical demand data for each distinguishable type of vendable product, said vend space allocation monitor means comprising vend selection monitoring means for monitoring over a period of time the historical demand for the various types of vendable products, processing means operatively connected to said vend selection monitoring means and said data storage means and operable as product demand is monitored to update said historical demand data stored in said data storage means to reflect the historical demand for the various types of vendable products, and communication means, said processing means operable in response to a terminating event for the time period to determine, based upon the historical demand data stored in said data storage means, space allocation information indicative of a preferred vend space allocation configuration, and to effect the communication to authorized personnel by said communication means of information indicative of such determination, the first sellout of a class of selectable vendable products constituting said terminating event.

93. Vend space allocation means for a vending system that has a plurality of distinguishable product storage areas for storage prior to vending of a plurality of distinguishable types of vendable products, wherein the number of distinguishable product storage areas exceeds the number of distinguishable types of vendable products intended to be vended by such vending system and wherein at least certain of the distinguishable product storage areas are configurable with one another to permit the vending of a common type of vendable product therefrom, such vending system including means operable by authorized personnel to establish and form from the plurality of distinguishable product storage areas a plurality of product storage allocation areas, each such product storage allocation area adapted to hold therein a plurality of products of a given type, the plurality of product storage allocation areas so established defining an established vend space allocation configuration, means for dispensing from each such product storage allocation area the products stored therein, means for controlling in response to an authorized request the dispensing of a requested distinguishable type of vendable product, and data storage means for storing historical demand data for each distinguishable type of vendable product, said vend space allocation monitor means comprising vend selection monitoring means for monitoring over a period of time the historical demand for the various types of vendable products, processing means operatively connected to said vend selection monitoring means and said data storage means and operable as product demand is monitored to update said historical demand data stored in said data storage means to reflect the historical demand for the various types of vendable products, and communication means, said processing means operable in response to a terminating event for the time period to determine, based upon the historical demand data stored in said data storage means, space allocation information indicative of a preferred vend space allocation configuration, and to effect the communication to authorized personnel by said communication means of information indicative of such determination, wherein said terminating event for a given period of time is the first event to occur from among a plurality of possible terminating events, said possible terminating events including both first sellout of a class of selectable vendable products and servicing of the vending system.

94. A method for determining and for communication to authorized personnel space allocation information indicative of a preferred vend space allocation configuration for a vending system capable of vending from among a plurality of classes of selectable vendable products a product from a selected product class, which vending system has a plurality of product storage areas for vend product storage, an established vend space allocation configuration allocating the product storage areas to the classes of selectable vendable products, and communication means, comprising the steps of:

(A) recording and updating for product vend operations as products are vended over a period of time the product demand by class of product, (B) determining from said recorded product demand for such period of time space allocation information indicative of a preferred vend space allocation configuration for such vending system, and (C) effecting communication by such communication means of such space allocation information to authorized personnel, wherein step (A) is terminated by the occurrence of a terminating event and the first sellout of a class of selectable vendable products constitutes said terminating event.

95. A method for determining and for communicating to authorized personnel space allocation information indicative of a preferred vend space allocation configuration for a vending system capable of vending from along a plurality of classes of selectable vendable products a product from a selected product class, which vending system has a plurality of product storage areas for vend product storage, an established vend space allocation configuration allocating the product storage areas to the classes of selectable vendable products, and communication means, comprising the steps of:

(A) recording and updating for product vend operations as products are vended over a period of time the product demand by class of product, (B) determining from said recorded product demand for such period of time space allocation information indicative of a preferred vend space allocation configuration for such vending system, and (C) effecting communication by such communication means of such space allocation information to authorized personnel, wherein step (A) is terminated by the occurrence of a terminating event, said terminating event for a given period of time is the first event to occur from among a plurality of possible terminating events, and said possible terminating events include both first sellout of a class of selectable vendable products and servicing of the vending system.

* * * * *

UNITED STATES PATENT AND TRADEMARK OFFICE

CERTIFICATE OF CORRECTION

PATENT NO. : 5,050,769

DATED : September 24, 1991

INVENTOR(S) : Joseph L. Levasseur

It is certified that error appears in the above-indentified patent and that said Letters Patent is hereby corrected as shown below:

Column 1, line 58, "Problem" should be --problem--;

Column 1, line 65, "beer" should be --been--;

Column 4, line 10, after "Figs. 5-7", insert --are--;

Column 4, line 27, " 20" " should be --20--;

Column 4, line 34, "(Figs." should be --Figs.--;

Column 4, line 37, "Particular" should be --particular--;

Column 5, line 42, after "and", insert --10--;

Column 6, line 63, " 16"' " should be --16""--;

Column 9, line 33, "Product" should be --product--;

Column 10, line 57, "BY" should be --By--;

Column 11, line 7, "have; 0.96," should be --have .96,--;

Column 11, line 8, "have, 0.72" should be --have .72--;

Column 12, line 68, "19" should be --19""--;

UNITED STATES PATENT AND TRADEMARK OFFICE

CERTIFICATE OF CORRECTION

PATENT NO. : 5,050,769

DATED : September 24, 1991

INVENTOR(S) : Joseph L. Levasseur

It is certified that error appears in the above-indentified patent and that said Letters Patent is hereby corrected as shown below:

Column 13, lines 7 & 8, "recon-junction" should be --conjunction--;

Column 20, line 14, "Portion" should be --portion--;

Column 22, line 40, "bending" should be --vending--;

Column 25, line 21, "refelct teh" should be --reflect the--;

Column 25, line 27, "are as" should be --areas--;

Column 26, line 28, "ending" should be --vending--;

Column 27, line 5, "." should be --,--;

Column 30, line 34, after "authorized", insert --personnel--;

Column 31, line 18, "communication" should be --communicating--; and

UNITED STATES PATENT AND TRADEMARK OFFICE

CERTIFICATE OF CORRECTION

PATENT NO. : 5,050,769

DATED : September 24, 1991

INVENTOR(S) : Joseph L. Levasseur

It is certified that error appears in the above-indentified patent and that said Letters Patent is hereby corrected as shown below:

Column 32, line 14, after "operatively", insert --connected to such detecting means, and wherein said processing--.

Signed and Sealed this

Eighth Day of November, 1994

Bruce Lehman

*Attest:*

BRUCE LEHMAN

*Attesting Officer*

*Commissioner of Patents and Trademarks*